US008042786B2

(12) United States Patent
Spindler

(10) Patent No.: US 8,042,786 B2
(45) Date of Patent: Oct. 25, 2011

(54) LOCKING SYSTEM HAVING MOUNTING BLOCK WITH MOUNTING ARM AND SLIDE MEMBER FOR SECURING CONCRETE FORM PANELS

(75) Inventor: Robert Spindler, Carol Stream, IL (US)

(73) Assignee: Dayton Superior Corporation, Dayton, OH (US)

( * ) Notice: Subject to any disclaimer, the term of this patent is extended or adjusted under 35 U.S.C. 154(b) by 1314 days.

(21) Appl. No.: 11/570,071

(22) PCT Filed: Jun. 16, 2005

(86) PCT No.: PCT/US2005/021397

§ 371 (c)(1),
(2), (4) Date: Dec. 6, 2006

(87) PCT Pub. No.: WO2006/009812

PCT Pub. Date: Jan. 26, 2006

(65) Prior Publication Data

US 2008/0011935 A1 Jan. 17, 2008

Related U.S. Application Data

(60) Provisional application No. 60/580,851, filed on Jun. 18, 2004.

(51) Int. Cl.

| | |
|---|---|
| ***E04G 17/00*** | (2006.01) |
| ***E05C 5/00*** | (2006.01) |
| ***E05B 9/08*** | (2006.01) |

(52) U.S. Cl. ..... 249/219.1; 249/45; 249/191; 249/196; 292/57; 292/337

(58) Field of Classification Search ..... 249/45, 249/191, 196, 219.1; 292/57, 59, 60, 62, 292/337

See application file for complete search history.

(56) References Cited

U.S. PATENT DOCUMENTS

| | | | | |
|---|---|---|---|---|
| 975,242 | A * | 11/1910 | Higgins et al. | 249/29 |
| 1,170,656 | A * | 2/1916 | Martineau et al. | 292/57 |
| 1,291,257 | A * | 1/1919 | Thompson | 269/246 |
| 1,458,399 | A * | 6/1923 | Fairley | 249/219.1 |
| 1,593,684 | A * | 7/1926 | Anakin | 70/128 |

(Continued)

OTHER PUBLICATIONS

International Search Report issued Oct. 3, 2006, regarding PCT/US05/21397.

*Primary Examiner* — Michael Safavi
(74) *Attorney, Agent, or Firm* — Thompson Hine LLP

(57) ABSTRACT

A locking system 24 for securing adjacent concrete form panels 20*a*, 20*b* together during assembly of a concrete form 22 is disclosed. The locking system 24 includes a mounting block 50 which is removably attachable to one of the adjacent panels 20*a*, 20*b*. A slide member 52 is mounted for sliding movement relative to the mounting block 50 between a first position retracted from aligned apertures 48 in side members 30 of the adjacent panels 20*a*, 20*b* and a second position extending through the aligned apertures 48. The slide member 30 includes a bolt member 92 mounted to rotate within the mounting block 50 in its extended position between locked and unlocked positions to secure the adjacent panels 20*a*, 20*b* together. Alternatively, the bolt member 206 is configured to receive a wedge member 204 at its projecting end or has a clamping member 304 mounted to rotate on the bolt member 306 for securing the adjacent panels 20*a*, 20*b* together.

46 Claims, 18 Drawing Sheets

U.S. PATENT DOCUMENTS 1,925,221 A * 9/1933 Wotnoske ..... 249/219.1
2,102,717 A * 12/1937 Jennings ..... 249/219.1
3,779,588 A * 12/1973 Raymon ..... 292/57
3,862,737 A * 1/1975 Fuston, Jr. ..... 249/196
4,194,717 A 3/1980 Easton et al.
4,470,624 A * 9/1984 Bisbing ..... 292/169
4,975,009 A * 12/1990 Easton et al. ..... 411/354
5,058,855 A 10/1991 Ward
5,352,001 A * 10/1994 Shieh ..... 292/57
6,691,976 B2 * 2/2004 Myers et al. ..... 249/191

* cited by examiner

LOCKING SYSTEM HAVING MOUNTING BLOCK WITH MOUNTING ARM AND SLIDE MEMBER FOR SECURING CONCRETE FORM PANELS

The present application claims the filing benefit of U.S. provisional application Ser. No. 60/580,851, filed Jun. 18, 2004, the disclosure of which is hereby incorporated herein by reference in its entirety.

FIELD OF THE INVENTION

The present invention relates generally to concrete form panels for use in assembling concrete forms and, more particularly, to a locking system for securing adjacent concrete form panels together during assembly of the concrete form.

BACKGROUND OF THE INVENTION

Pre-fabricated concrete form panels are used to assemble opposing walls of a concrete form. A number of the concrete panels are typically positioned adjacent each other, and may also be placed one on top of another in a gang or group, to form cavities between the opposing walls of the panels of various shapes and sizes into which wet concrete may be poured. Typically, the panels are abutted together on their adjacent sides and are securely fastened together by two or more locking devices, such as bolts and nuts, bolts and wedges, or hinged latches, which have a portion of the locking device passing through aligned holes or slots formed in abutting side members of the adjacent panels.

The opposing walls of the concrete form are connected together and held in spaced apart relationship by horizontally extending tie rods which are connected to the opposing walls of the concrete form. The tie rods are typically secured in place by the same locking devices used to secure the adjacent panels together. The tie rods keep the opposing walls of the concrete form from spreading apart when the wet concrete is poured into the cavities. When the concrete dries, the concrete form panels are removed and may be reused.

Known locking devices of the past suffer from several shortcomings and drawbacks. For example, these locking devices may have several loose pieces which must be carried by workers as the panels are positioned and secured together to assemble the concrete form. A large quantity of locking hardware is oftentimes necessary to secure adjacent panels of the concrete form together so the locking hardware is typically carried by the workers in large containers as they erect the concrete forms. Carrying of the locking hardware can be cumbersome for the workers and the loose pieces may be accidentally dropped. The loose pieces of the locking hardware must be gathered as the panels are disassembled and are oftentimes lost or misplaced.

In addition, known locking systems of the past may have one or more components permanently attached to portions of the panel. When the panel becomes damaged and must be discarded, components of the locking hardware may be discarded with the panel as well. All of these drawbacks and shortcomings may lead to increased costs of labor and materials.

Accordingly, there is a need for a locking system which secures adjacent panels together with a minimum number of loose parts. There is also a need for a locking system which is readily attachable and detachable from the panel so it can be reused on other panels as may be required.

SUMMARY OF THE INVENTION

The present invention overcomes the foregoing and other shortcomings and drawbacks of locking systems heretofore known for securing concrete form panels together. While the invention will be described in connection with certain embodiments, it will be understood that the invention is not limited to these embodiments. On the contrary, the invention includes all alternatives, modifications and equivalents as may be included within the spirit and scope of the present invention.

A suitable concrete form panel for use with the locking system of the present invention has a pair of opposing horizontal end members and a pair of opposing vertical side members which are connected together to form a reinforcing panel frame. A plywood facing or relatively thin metal sheet is secured to the panel frame to form a panel wall. The frame also has a series of horizontal cross members which are vertically spaced apart along the height of the panel and are connected at their opposite ends to the opposing side members. Each end of the cross member has a slot formed therein which extends from connections of the cross member with the opposing side members. Each of the side members has a vertical series of slots or openings formed therein so that the slots of adjacent panels are generally aligned when the panels are assembled in side-by-side abutting relationship to erect the concrete form.

According to one aspect of the present invention, each locking system includes a mounting block, an elongated slide member supported for sliding movement relative to the mounting block, and an elongated mounting arm connected to the mounting block. The mounting block is configured to be removably attached to the cross member of the panel so as to align a projecting end of the slide member with the aligned slots of the adjacent panels. The slide member is movable between a first position wherein the projecting end is retracted from the aligned slots and a second position wherein the projecting end extends through the aligned slots for securing the panels together.

The mounting arm provides simple and accurate installation and positioning of the mounting block on the cross member of the panel. The mounting arm includes an upstanding pin at one end which is configured to fit within one of the slots formed on the cross member. The pin engages the slot and creates a pivot connection between the locking system and the panel so that the mounting block can be pivoted on the mounting arm into frictional engagement with the cross member. The mounting arm assures the mounting block is properly spaced inwardly from the vertical side member of the panel onto which it is installed and prevents movement of the mounting block either toward the vertical side member or toward the center of the panel during use of the locking system.

In one embodiment, the slide member comprises an elongated bolt member and an elongated bolt support member which are mounted for sliding movement together relative to the mounting block. The bolt member is mounted to rotate relative to the mounting block and the bolt support member when the slide member is moved to the extended position. The bolt member has locking faces which are brought into engagement with inside faces of the adjacent panels when the bolt is rotated to a locked position to secure the adjacent panels together.

According to another aspect of the present invention, the locking system includes a mounting block, an elongated slide member supported for sliding movement relative to the mounting block, a mounting arm and a wedge member. In this embodiment, the slide member comprises an elongated bolt member having an elongated slot formed in its projecting end. The wedge member is configured to be inserted into the slot when the bolt member is moved to its extended position to secure the adjacent panels together.

According to another aspect of the present invention, the locking member includes a mounting block, an elongated slide member supported for sliding movement relative to the mounting block, a mounting arm and a clamp member. In this embodiment, the slide member comprises an elongated bolt member and the clamp member is rotatably mounted on the bolt member. The clamping member is configured to be rotated on the bolt member between unlocked and locked positions. In the locked position, a pair of spaced apart legs of the clamp member are brought into engagement with the inside faces of the adjacent panels to secure the adjacent panels together.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
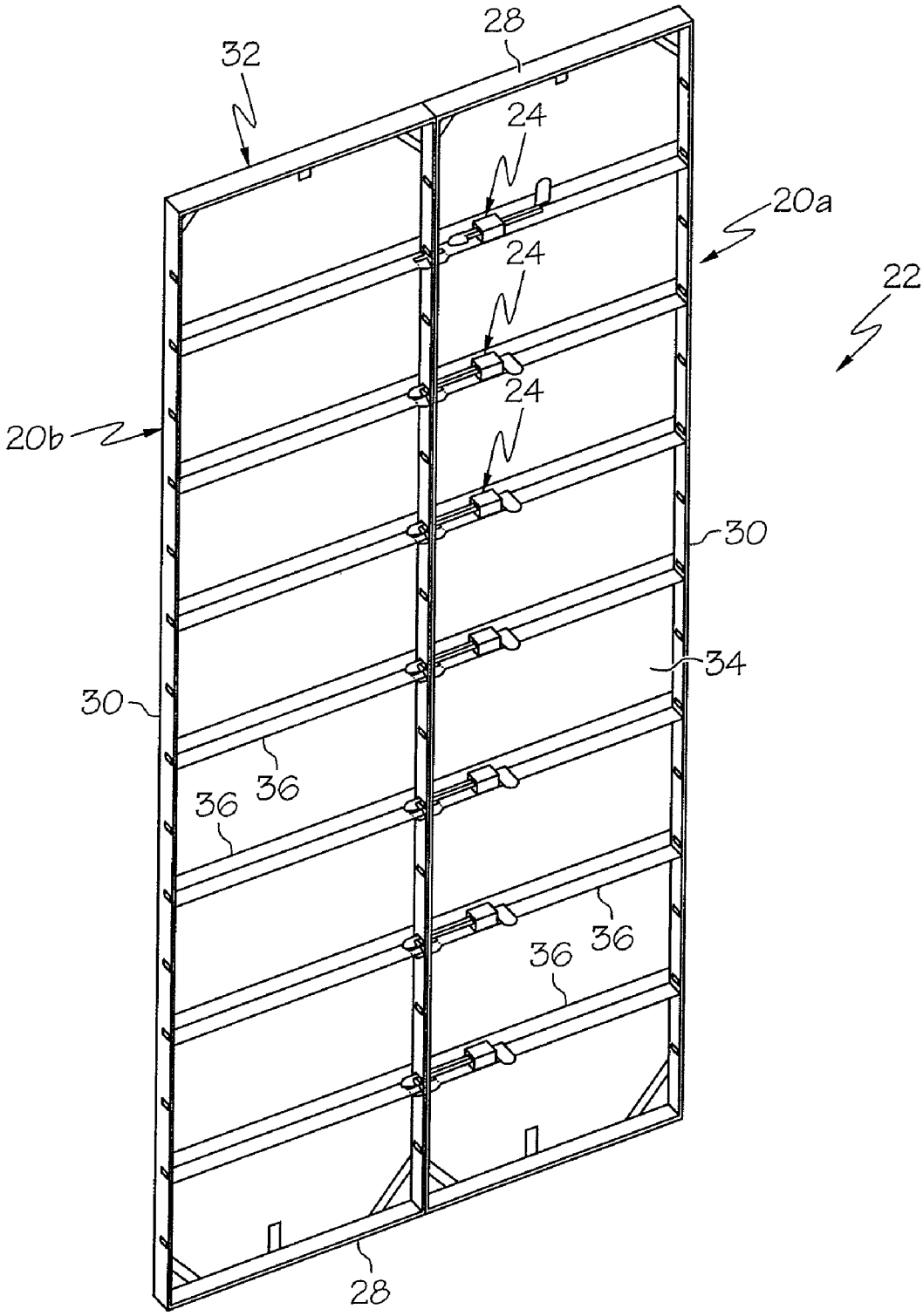
FIG. 1 is a perspective view of two adjacent concrete panel forms secured together by multiple locking systems according to one embodiment of the present invention.

Referring to the figures, and to FIG. 1 in particular, a pair of adjacent concrete form panels 20*a*, 20*b* forming one wall of a concrete form 22 are shown secured together by a series of vertically spaced apart locking systems 24 in accordance with one embodiment of the present invention. During assembly of a concrete form, a number of panels 20*a*, 20*b* (two shown) are typically placed side-by-side, and may also be placed one on top of another in a gang or group to erect opposing walls of the concrete form. The two walls of the concrete form are connected together and held in spaced apart relationship by horizontally extending tie rods 26 (one shown in FIGS. 6 and 7) which are connected to the opposing walls of the concrete form. By way of example, a typical concrete form panel 20*a*, 20*b* may have a width of approximately two feet and a height of approximately eight feet, although other panel dimensions are possible as well.

One suitable concrete form panel 20*a*, 20*b* for use in the present invention to erect concrete forms is the "Steel-Ply" panel manufactured by Symons Corporation of Des Plaines, Ill. and its description is provided herein by way of example only and without limitation. Each panel 20*a*, 20*b* has a pair of opposed horizontal end members 28 and a pair of opposed vertical side members 30 which are connected together to form a reinforcing panel frame 32. A rectangular plywood facing or relatively thin steel sheet 34 is secured to the panel frame 32 to form a panel wall as is well known in the art.

The frame 32 also includes a series of horizontal cross members 36 in the form of angle bars which are vertically spaced apart along the height of the panel 20*a*, 20*b* and are connected at their opposite ends to the opposing side members 30. The cross members 36 are oriented generally parallel to the end members 28 and perpendicular to the side members 30. As shown in FIGS. 4-8, each cross member 36 is L-shaped and comprises a horizontal leg 38 and an upstanding vertical leg 40. Each end of the cross members 36 has a slot 42 formed through the horizontal leg 38 which extends toward the center of the panels 20*a*, 20*b* from the connections of the cross member 36 with the side members 30. In one embodiment, the horizontal end members 28, and similarly the vertical side members 30, are structural steel members each having a generally shallow U-shaped cross section as shown in FIGS. 4-8.

Edge notches 44 are formed at intervals along the vertical side members 30 so that the notches 44 of adjacent panels 20*a*, 20*b*, when placed in side-by-side abutting relationship, form openings 46 extending through the adjacent side members 30. The openings 46 formed by the notches 44 provide for entry of the ends of the tie rods 26 as will be described in greater detail below. Each of the vertical side members 30 is provided with a vertical series of slots or openings 48 formed therein. Each slot 48 is aligned with the center of respective notches 44 formed in each vertical side member 30 so that the slots 48 of adjacent panels 20*a*, 20*b* are generally aligned when the panels 20*a*, 20*b* are assembled in side-by-side abutting relationship to erect the concrete form 22.

According to one embodiment of the present invention as shown in FIGS. 1-7, each locking system 24 includes a mounting block 50, an elongated slide member 52 supported for sliding movement relative to the mounting block 50, and an elongated mounting arm 54 connected to the mounting block 50. As will be described below, the mounting block 50 is configured to be removably attached to the horizontal leg 38 of the cross member 36 so as to align a projecting end 56 of the slide member 52 with the aligned slots 48 of the adjacent panels 20*a*, 20*b*. The slide member 52 is movable between a first position wherein the projecting end 56 of the slide member 52 is retracted from the aligned slots 48 (FIG. 5) and a second position wherein the projecting end 56 extends through the aligned slots 48 (FIG. 6) for securing the adjacent panels 20*a*, 20*b* together as described in detail below.

Figure 3:
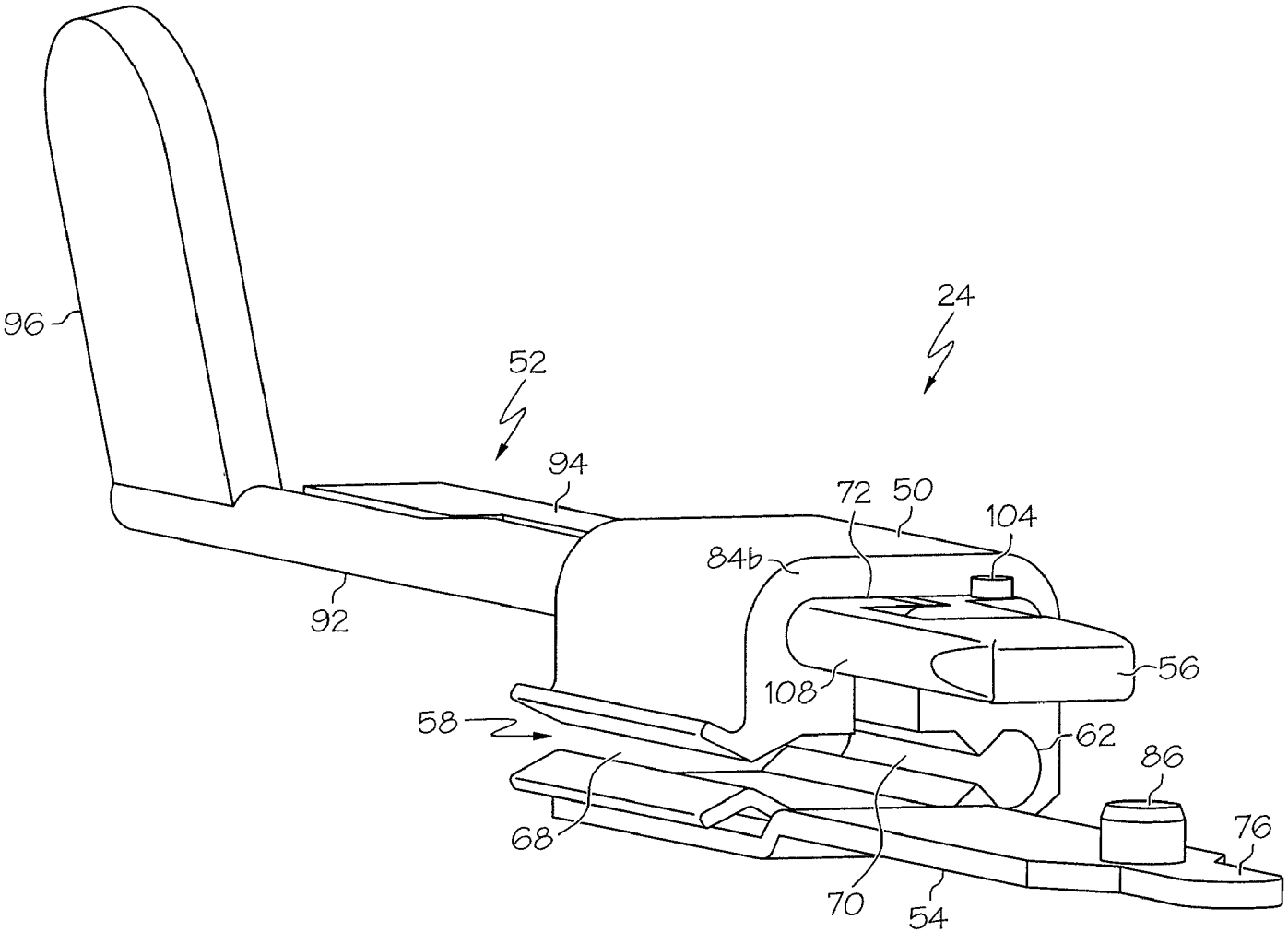
Figure 3A:
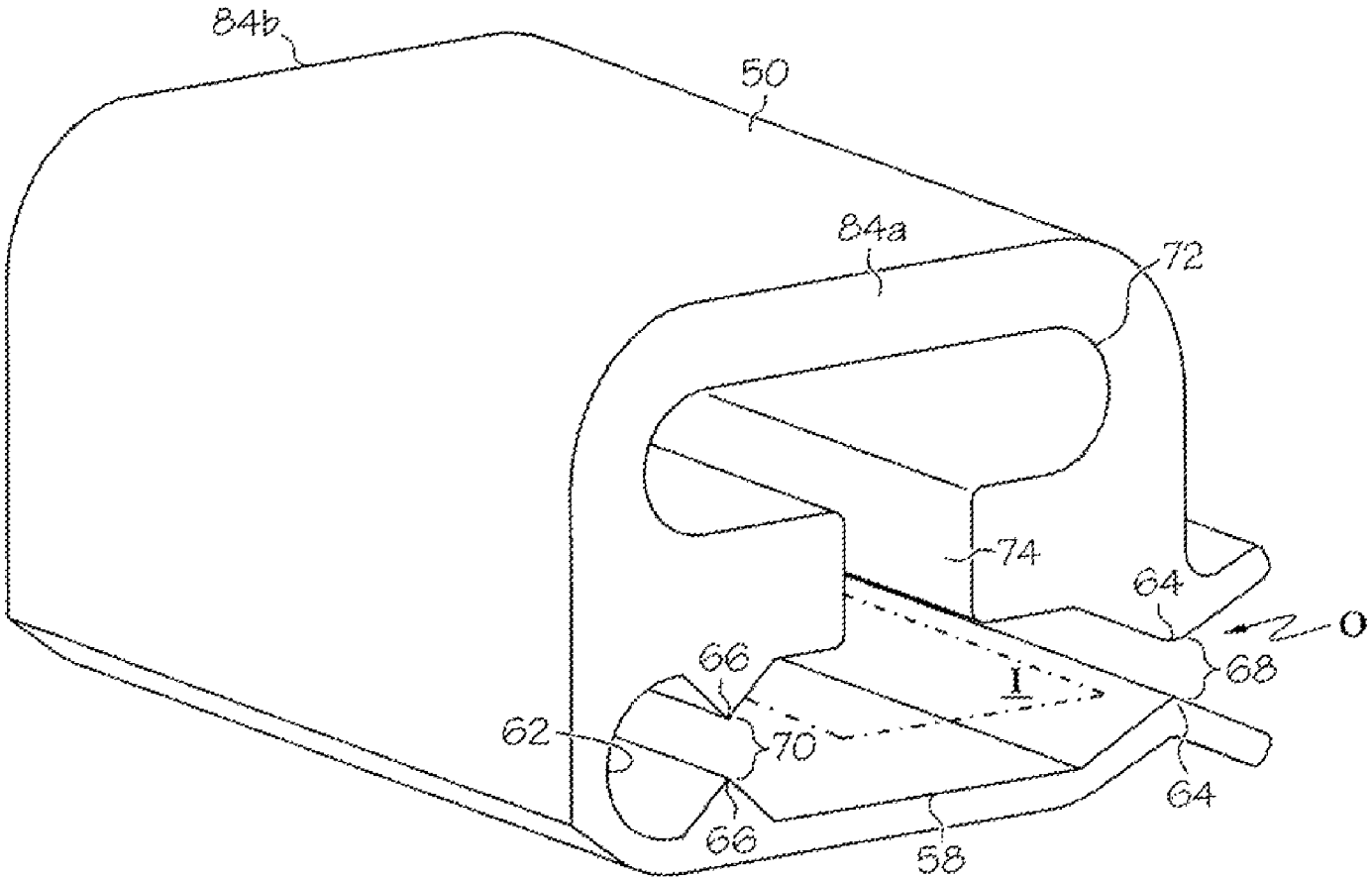
FIG. 3A is a perspective view of a mounting block used in the locking system shown in FIGS. 1-3.

As shown in FIG. 3A, the mounting block 50 has a slot 58 formed therein extending across its width which is configured to frictionally engage the horizontal leg 38 of the cross member 36. The mounting block 50 is hammered onto the cross member 36 until the elongated edge 60 of the horizontal leg 38 passes through a forward opening "O," along cross member insertion plane "I", and engages a stop face 62 within the slot 58. The slot 58 has a pair of opposed forward projections 64 and a pair of opposed rearward projections 66 which extend generally across its width. The gap 68 defined between the opposed forward projections 64 may be set to less than the thickness of the horizontal leg 38 to allow for a tight grip on the horizontal leg 38. The gap 70 defined between the opposed rearward projections 66 may be set at the nominal thickness of the horizontal leg 38. This prevents the mounting block 50 from rotating up or down around the points of contact of the opposed forward projections. 64 with the horizontal leg 38 when the mounting block 50 is engaged with the cross member 36. Of course, other configurations of slots 58 and other methods of attaching the mounting block 50 to the cross member 36 are possible as well without departing from the spirit and scope of the present invention.

The mounting block 50 has a horizontal opening or bore 72 extending across its width which is configured to support the slide member 52 for sliding movement relative to the mounting block 50 between the retracted and extended positions. Of course, other configurations of the opening 72 are possible as well for slidably supporting the slide member 52. When the mounting block 50 is fully engaged with the cross member 36, the opening 72 of the mounting block 50 is aligned with the aligned slots 48 of the adjacent panels 20*a*, 20*b* so as to align the projecting end 56 of the slide member 52 with the aligned slots 48. In one embodiment, the slide member 52 is mounted for sliding movement within the mounting block 50 between the retracted and extended positions. Of course, other slidable mountings of the slide member 52 and mounting block 50 are possible as well without departing from the spirit and scope of the present invention. An opening 74 in the mounting block 50 communicates with the opening 72 and the slot 58 so that any built up concrete within the mounting block 50 can be easily cleaned out with a suitable tool (not shown).

Referring to FIGS. 2-3, 3E and 4-5, the mounting arm 54 provides simple and accurate installation and positioning of the mounting block 50 on the horizontal leg 38 of the cross member 36. The mounting arm 54 assures that the mounting block 50 is properly spaced inwardly from the vertical side member 30 of the panel 20*a* onto which it is installed and prevents movement of the mounting block 50 either toward the vertical side member 30 or toward the center of the panel 20*a* in use of the locking system 24 as described below.

Figure 2:
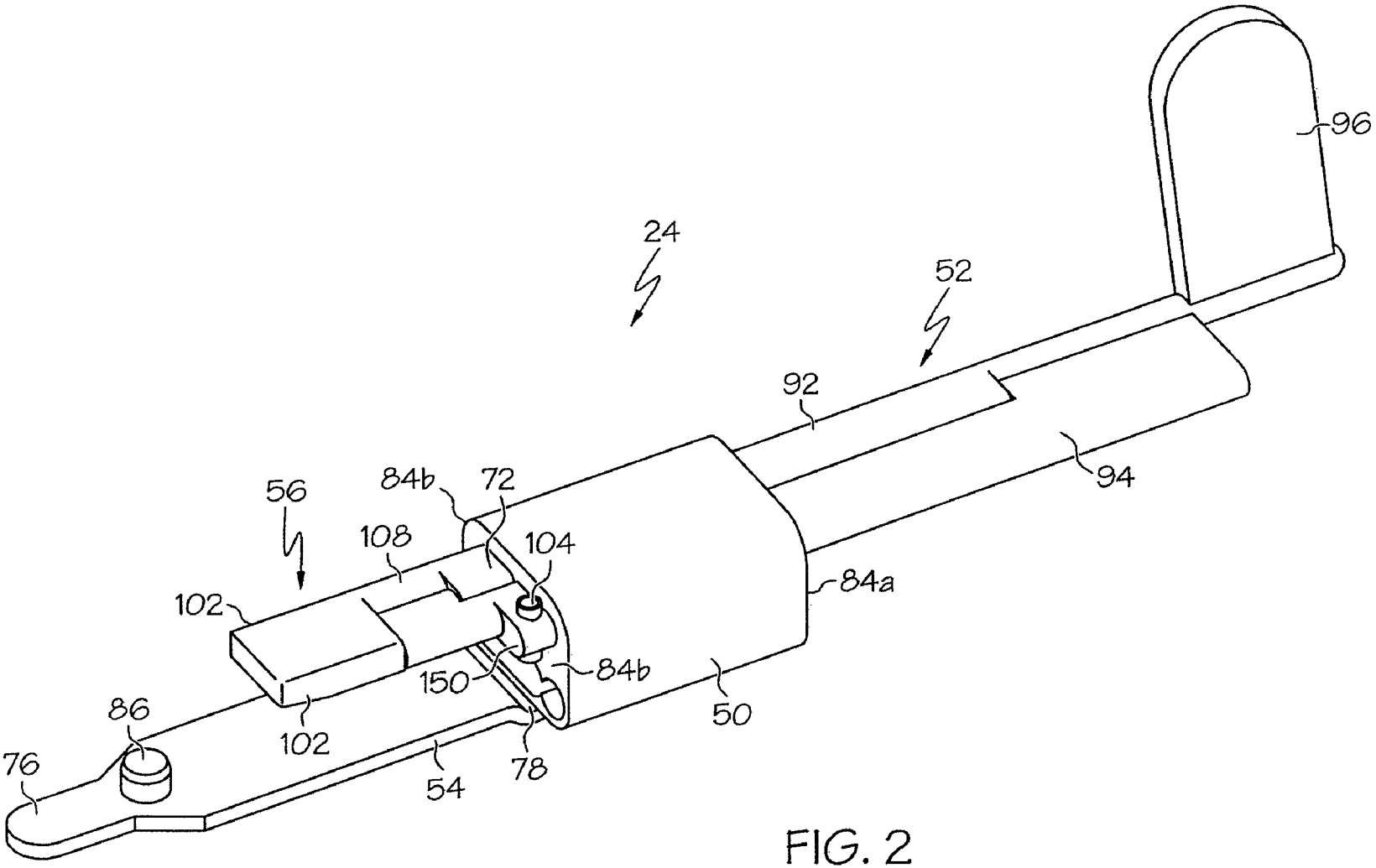
FIGS. 2 and 3 are perspective views of the locking system shown in FIG. 1.
Figure 3B:
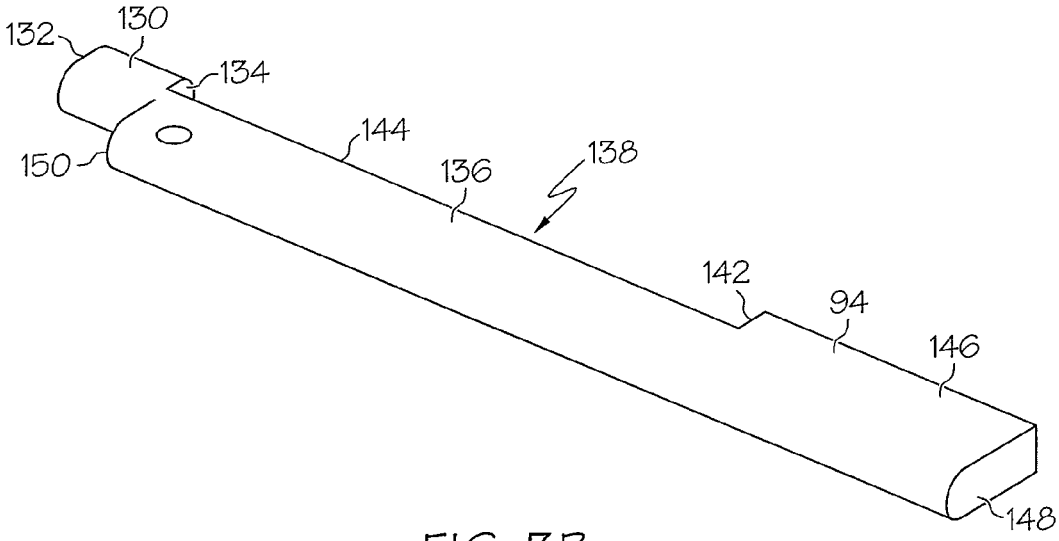
FIG. 3B is a perspective view of a bolt support member used in the locking system shown in FIGS. 1-3.
Figure 3C:
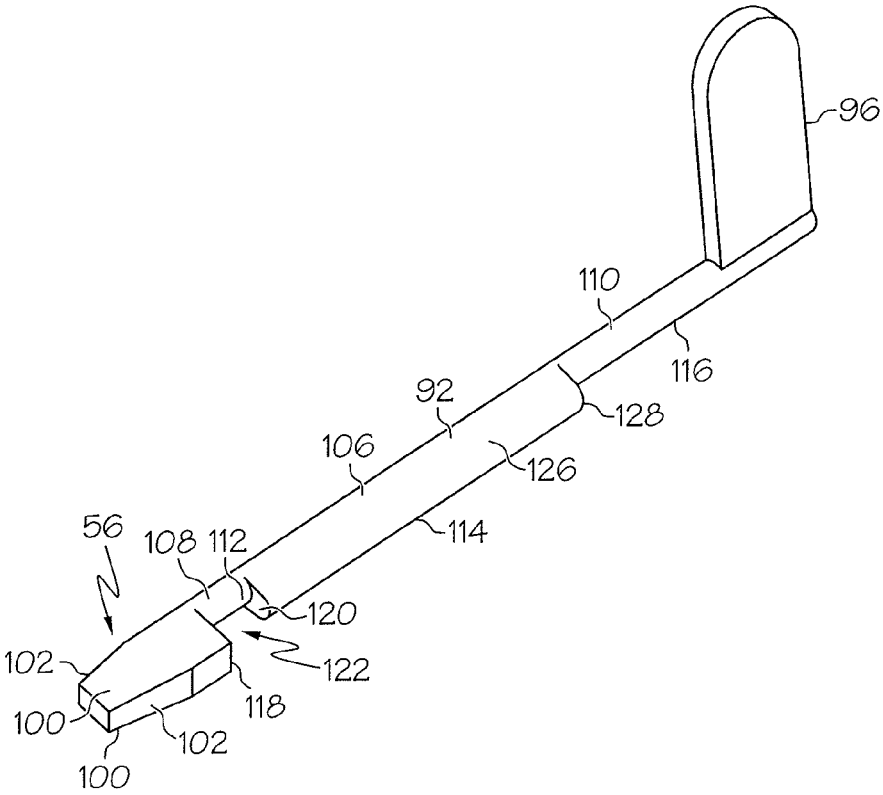
FIG. 3C is a perspective view of a bolt member used in the locking system shown in FIGS. 1-3.
Figure 3D:
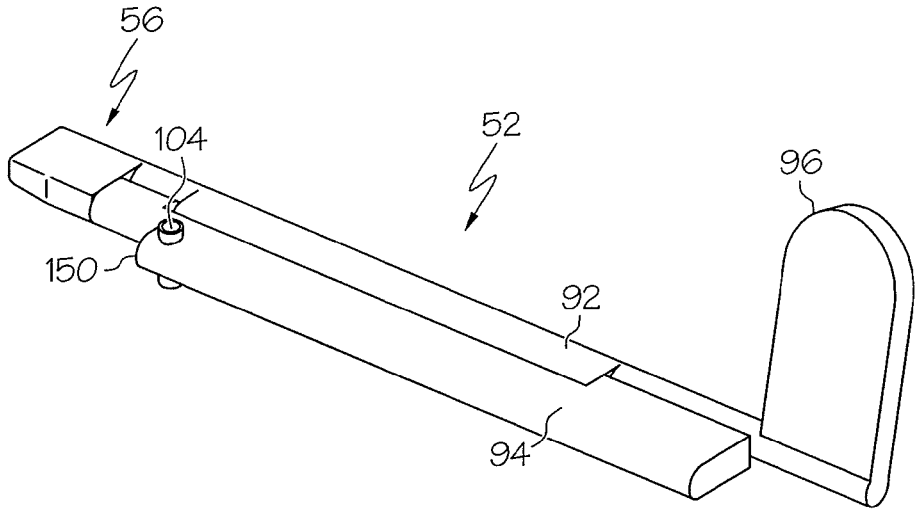
FIG. 3D is a perspective view of a slide member used in the locking system shown in FIGS. 1-3, showing the bolt support member of FIG. 3B assembled with the bolt member of FIG. 3C.
Figure 3E:
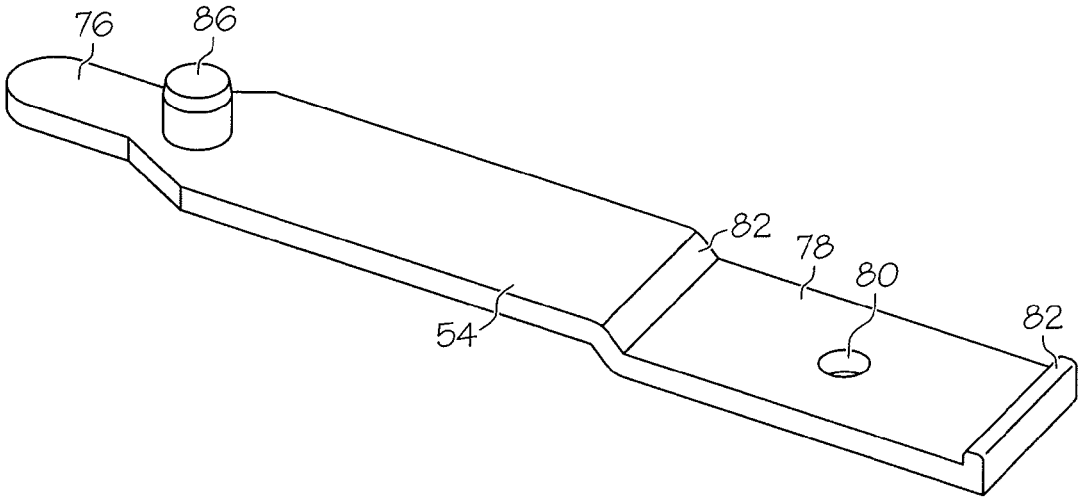
FIG. 3E is a perspective view of a mounting arm used in the locking system shown in FIGS. 1-3.

As shown in FIGS. 2 and 3E, the mounting arm 54 comprises an elongated member having an arcuate nose or tip 76 at one end and a recessed seat 78 for supporting the mounting block 50 at its opposite end. In one embodiment, the mounting block 50 is secured within the recessed seat 78 of the mounting arm 54 by a bolt (not shown) extending through an aperture 80 (FIG. 3E) formed in the mounting arm 54 and into engagement with the mounting block 50. Alternatively, the mounting block 50 may be welding or otherwise secured within the recessed seat 78. The aperture 80 is used to align the mounting block 50 and mounting arm 54 when these parts are welded together. The recessed seat 78 has a width slightly greater than the width of the mounting block 50 and defines a pair of upstanding parallel edges 82 (FIG. 3E) which are positioned adjacent opposite sides 84*a*, 84*b* of the mounting block 50. The edges 82 of the recessed seat 78 prevent the mounting block 50 from rotating on the mounting arm 54 when the parts are bolted together.

Figure 4:
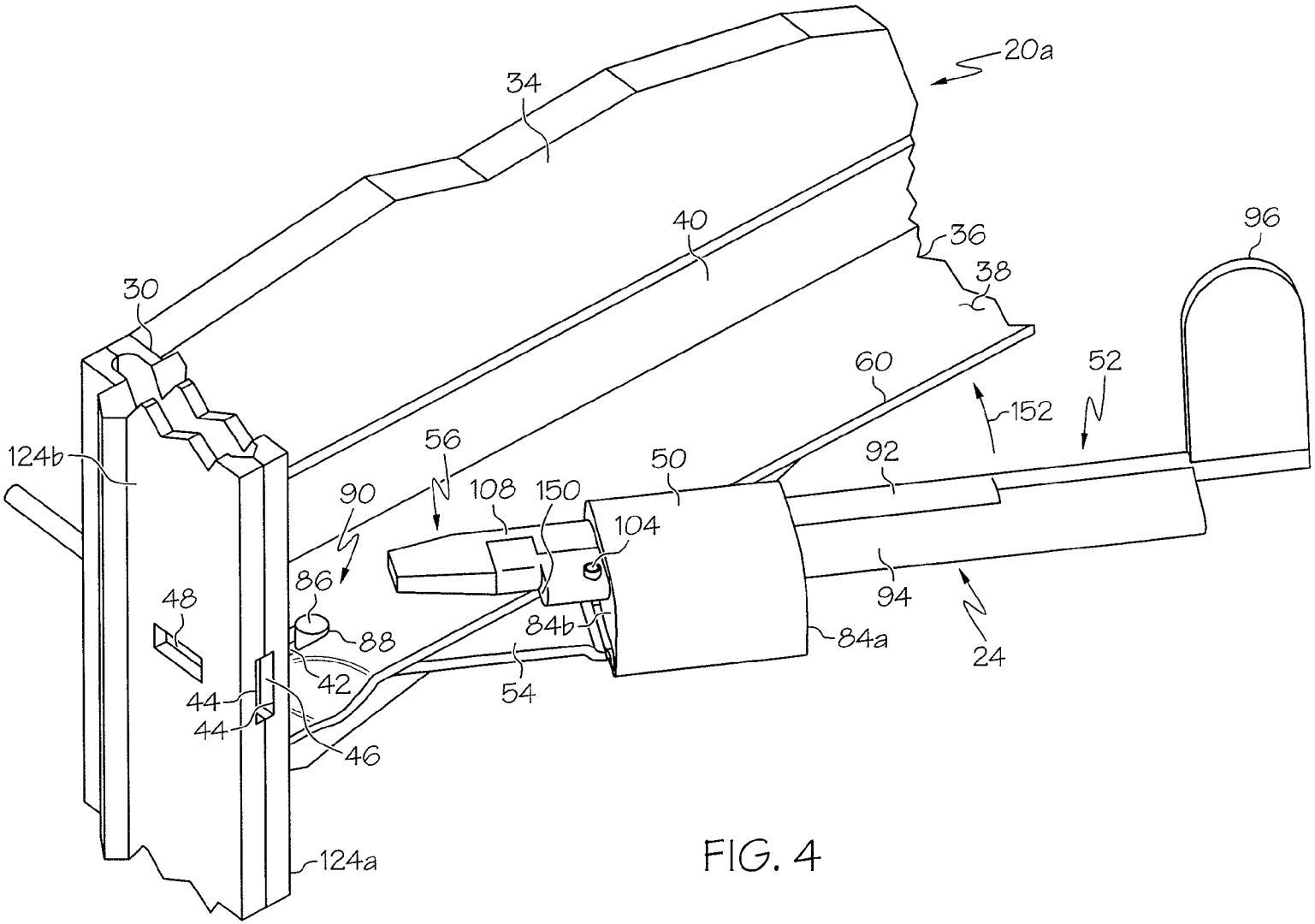
FIGS. 4 and 5 are perspective views of the locking system of FIGS. 1-3, showing installation of the locking system on one of the adjacent concrete form panels shown in FIG. 1 with the locking system in an unlocked position.
Figure 5:
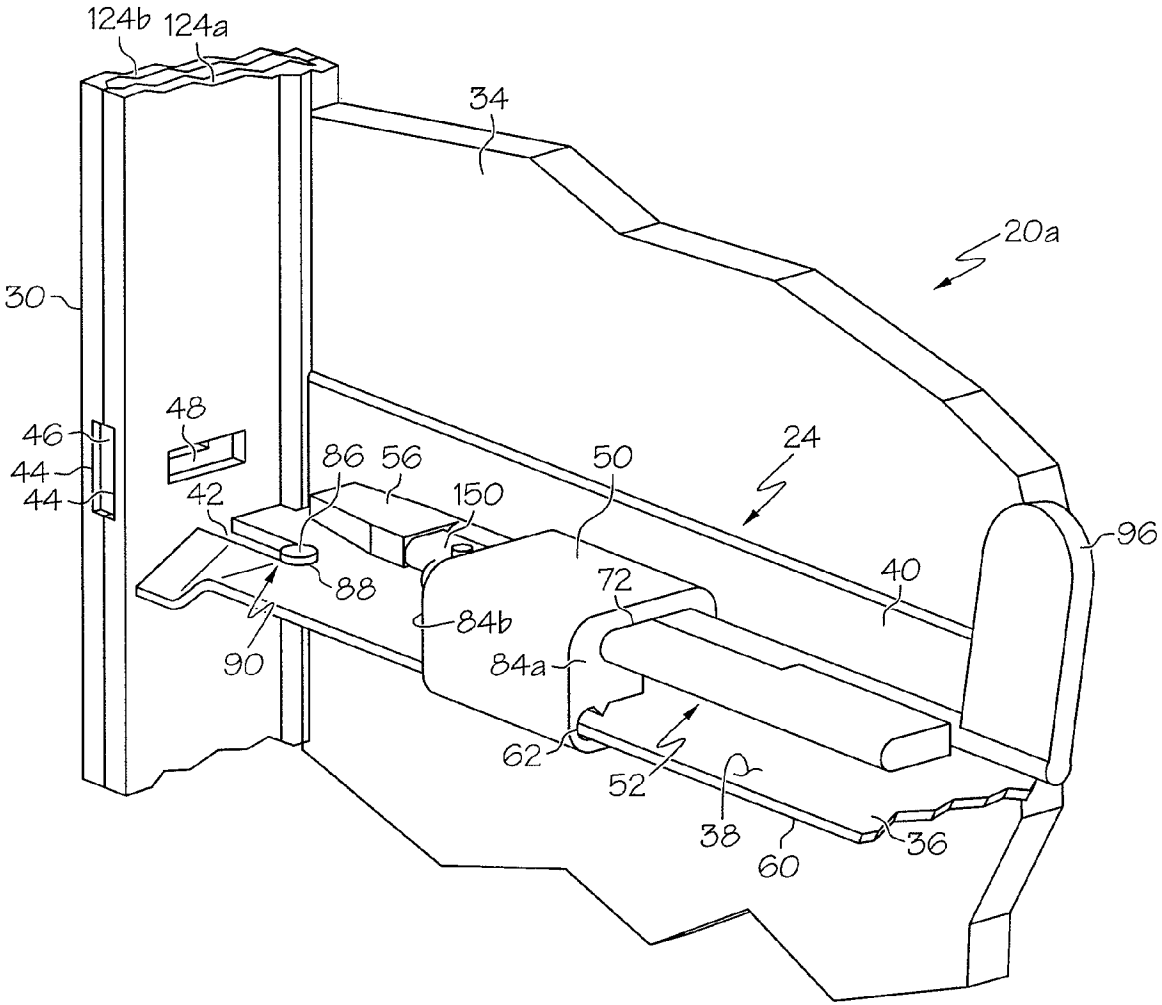

Further referring to 2-3, 3E and 4-5, the mounting arm 54 has an upstanding pin 86 mounted adjacent the arcuate nose 76. The pin 86 is configured to fit within the slot 42 formed in the horizontal leg 38 of the cross member 36 when the locking system 24 is installed onto the panel 20*a* as shown in FIGS. 4 and 5. The pin 86 engages an arcuate face 88 of the slot 42 and creates a pivot connection 90 between the locking system 24 and the panel 20*a* when the locking system 24 is installed onto the panel 20*a* as described in greater detail below. The pin 86 is spaced from the arcuate nose 76 so that when the pin 86 is received in the slot 42 and engages the arcuate face 88, the mounting block 50 can be pivoted on the mounting arm 54 into engagement with the cross member 36. In this installed position, the arcuate nose 76 of the mounting arm 54 is located in close proximity to, or in contact with, the vertical side member 30 of the panel 20*a* onto which it is installed. The engagement of the pin 86 with the arcuate face 88 of the slot 42 prevents movement of the locking system 24 toward the center of the panel 20*a*. Contact of the arcuate nose 76 of the mounting arm 54 with the vertical side member 30 prevents movement of the locking system 24 toward the side member 30 during installation and use of the locking system 24 as described below.

Figure 6:
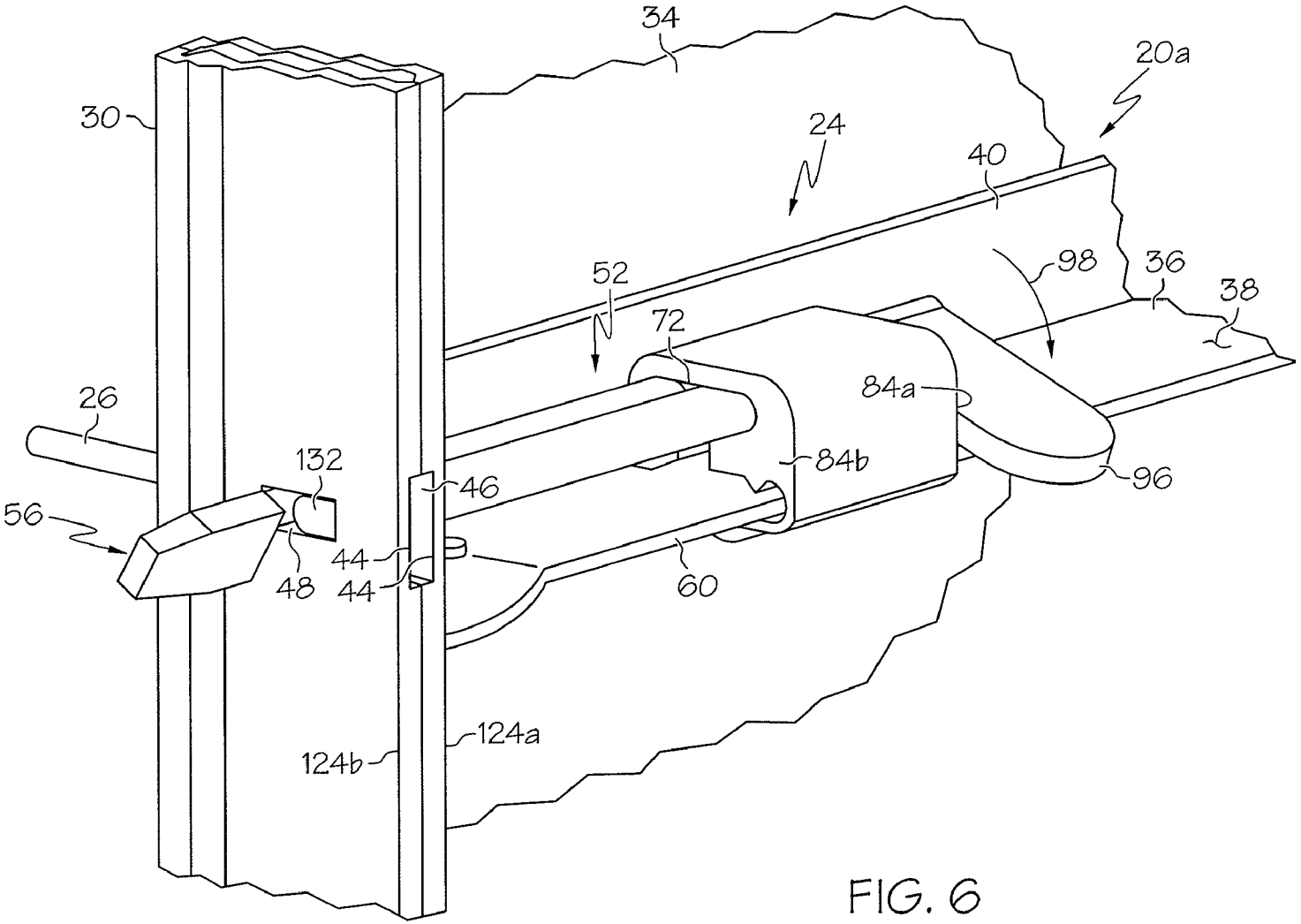
FIG. 6 is a perspective view of the locking system of FIGS. 1-3, showing the locking system in a locked position to secure the adjacent concrete form panels together.
Figure 7:
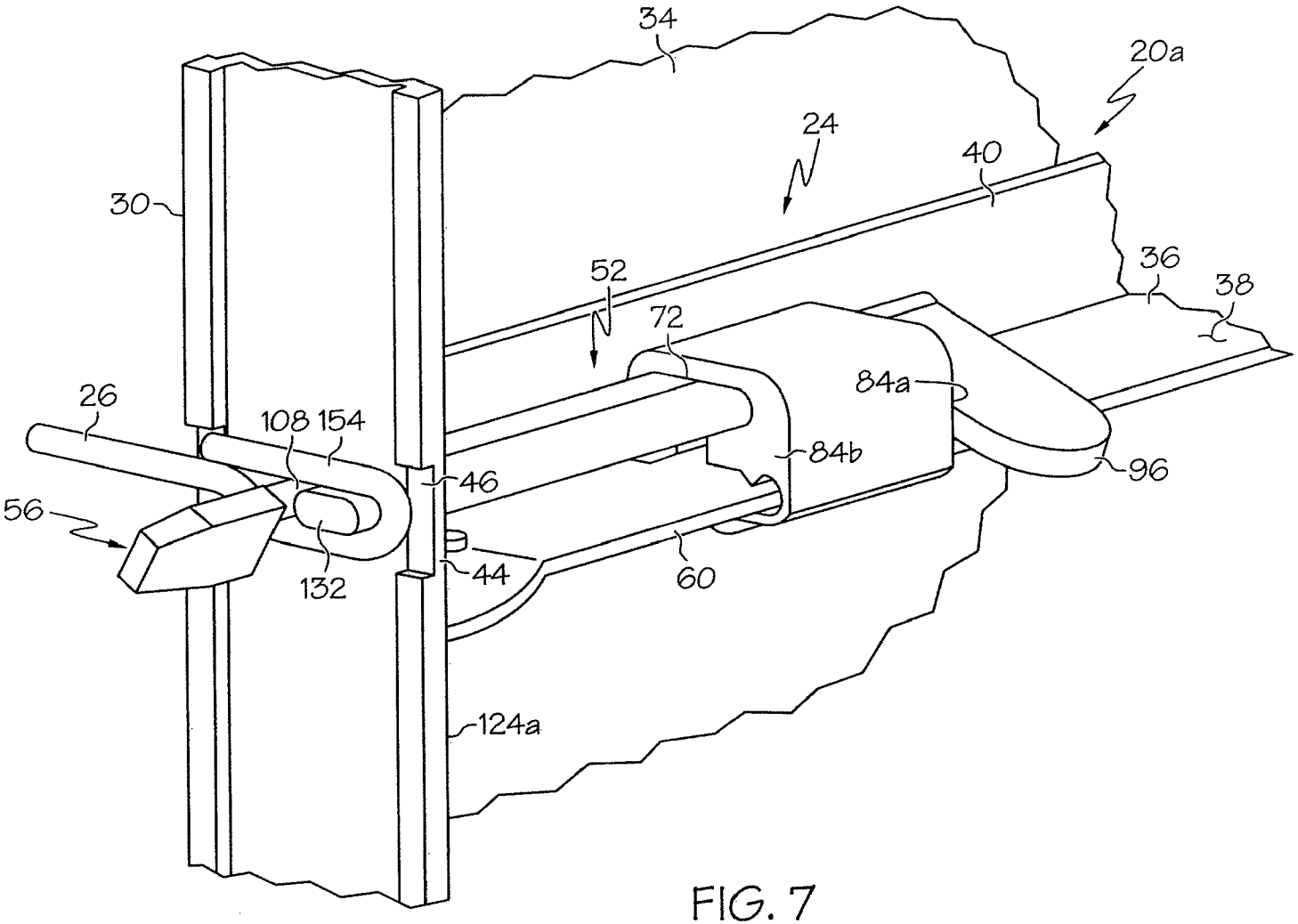
FIG. 7 is a view similar to FIG. 6 with one of the adjacent concrete form panels removed, showing the locking system engaging a form tie rod.

In one embodiment, as shown in FIGS. 2-3, 3B-3D and 4-7, the slide member 52 comprises an elongated bolt member 92 and an elongated bolt support member 94 which are mounted for sliding movement together within the opening 72 formed in the mounting block 50. The bolt member 92 is also mounted to rotate relative to the mounting block 50 and the bolt support member 94 when the slide member 52 is moved to the extended position and the bolt member 92 is rotated to secure the adjacent panels 20*a*, 20*b* together as shown in FIGS. 6 and 7.

A handle 96 is provided on the bolt member 92 so that the slide member 52 can be manually moved or hammered from its retracted position to the extended position to move the projecting end 56 of the slide member 52 through the aligned slots 48. In the retracted position shown in FIG. 5, the handle 96 extends upwardly and tilts toward the plywood facing or thin steel sheet 34 at an angle of about 7° from vertical, although other orientations are possible as well. With the slide member 52 moved to the extended position, the handle 96 is then rotated manually or with a hammer in the direction of arrow 98 in FIG. 6 to rotate the bolt member 92 to the locked position shown in FIGS. 6 and 7 for securing the adjacent panels 20*a*, 20*b* together. It will be appreciated that other structures are possible as well for rotating the bolt member 92 to the locked position as will be appreciated by those skilled in the art.

As shown in FIG. 3C, the projecting end 56 of the bolt member 92 has opposed upper and lower faces 100 and opposed side faces 102 which taper at the projecting end 56. This tapering facilitates insertion of the projecting end 56 through the aligned slots 48 of the adjacent panels 20*a*, 20*b* and the tie rod 26 when the slide member 52 is moved to the extended position as shown in FIGS. 6 and 7. The bolt support member 94 has pin 104 extending therethrough which engages the side 84*b* of the mounting block 50 to prevent separation of the slide member 52 and mounting block 50 when the slide member 52 is moved to the retracted position shown in FIGS. 2-3 and 4-5.

As shown in FIGS. 3B-3D, the bolt member 92 and bolt support member 94 have generally complimentary configurations so that the bolt member 92 is supported by the bolt support member 94 during travel of these parts between the retracted and extended positions. The bolt support member 94 also supports the bolt member 92 during rotation of the bolt member 92 to the locked position shown in FIGS. 6 and 7 as described below.

The projecting end 56 of the bolt member 92 is connected to an intermediate portion 106 of the bolt member 92 through a shaft portion 108. The handle 96 is connected to the intermediate portion 106 of the bolt member 92 through a shaft portion 110. Each of the shaft portion 108, intermediate portion 106 and shaft portion 110 has arcuate faces 112, 114 and 116, respectively, which confront the bolt support member 94. The arcuate faces 112, 114 and 116 facilitate rotation of the bolt member 92 relative to the bolt support member 94 when the bolt member 92 is rotated to the locked position for securing the adjacent panels 20*a*, 20*b* together. The shaft portion 108 facilitates rotation of the bolt member 92 within the aligned slots 48 after the projecting end 56 has been extended through the slots 48 and the tie rod 26 as shown in FIG. 7. The shaft portion 110 facilitates rotation of the bolt member 92 within the mounting block 50.

As shown in FIG. 3C, the bolt member 92 has confronting and spaced apart locking faces 118 and 120. The locking faces 118 and 120 and shaft portion 108 define a notch 122 in the bolt member 92. The width of the notch 122 is generally equal to the width between inside faces 124*a*, 124*b* of the adjacent panels 20*a*, 20*b*. The locking face 118 is angled about 1° from the shaft portion 108 toward the locking face 120. Similarly, the locking face 120 is angled about 1° from the shaft portion 108 toward the locking face 118. In this way, the notch 122 in the bolt member 92 is wider toward the shaft portion 108 and narrows slightly toward the opening of the notch 122. The intermediate portion 106 of the bolt member 92 has a projection portion 126 which extends between the locking face 120 and a spaced apart face 128 of the bolt member 92.

Referring now to FIG. 3B, the bolt support member 94 has an end portion 130 which extends into the notch 122 of the bolt member 92. The end portion 130 has faces 132 and 134 which confront the locking faces 118 and 120, respectively, of the bolt member 92. The bolt support member 94 has an intermediate portion 136 including a notch 138 formed therein. The notch 138 is defined by the face 134, a confronting and spaced apart face 142, and a face 144 extending between the faces 134 and 142 of the bolt support member 94. The notch 138 of the bolt support member 94 receives the projection portion 126 of the bolt member 92 as shown in FIG. 3D so that the faces 120 and 128 of the bolt member 92 confront the faces 134 and 142, respectively, of the bolt support member 94 and the arcuate face 114 of the bolt member 92 confronts the face 144 of the bolt support member 94. In this way, the bolt member 92 and bolt support member 94 are mounted to slide together relative to the mounting block 50 between the extended and retracted positions.

The bolt support member 94 has an end portion 146 which extends between the face 142 and an end face 148 of the bolt support member 94. The end portion 146 confronts the arcuate face 116 of the shaft portion 110 between the face 128 and the handle 96 of the bolt member 92. The bolt support member 94 also has a face 150 which is generally aligned with the face 134 on the end portion 130 and the locking face 120 of the bolt member 92 for purposes described below.

In use of the locking system 24 according to the embodiment of FIGS. 1-7, each locking system 24 is first installed onto its respective cross member 36 of the panel 20*a* as shown in FIGS. 4 and 5 with the slide member 52 of each locking system 24 moved to its retracted position. To this end, the pin 86 of the mounting arm 54 is engaged in the slot 42 formed in the horizontal leg 38 of its respective cross member 36. The locking system 24 is then pivoted about the pivot connection 90 toward the panel 20*a*, as represented by arrow 152 in FIG. 4, so that the slot 58 formed in the mounting block 50 frictionally engages the cross member 36. The mounting block 50 is then hammered onto the cross member 36 until the elongated edge 60 of the horizontal member 36 engages the stop face 62 within the slot 58 as shown in FIG. 5. A locking system 24 may be installed on each of the cross members 36 or on fewer selected cross members 36 of the panel 20*a*.

Next, the pair of panels 20*a*, 20*b* are placed in side-by-side relationship to erect the wall of the concrete form 22. The slots 48 in the adjacent vertical side members 30 are aligned and the form tie rods 26 (FIG. 7) are inserted into the openings 46 formed by the edge notches 44 of the side members 30. Each slide member 52 is then moved manually or hammered from its retracted position to its extended position so that the projecting end 56 of each slide member 52 extends through its respective aligned slots 48 and a looping end 154 (FIG. 7) of the tie rod 26. In its extended position, the shaft portion 110 of the bolt member 92 and the end portion 146 of the bolt support member 94 are located within the mounting block 50. The sliding movement of the slide member 52 to the extended position stops when the face 150 of the bolt support member 94 contacts the inside face 124*a* of the side member 30.

Finally, the bolt members 92 of each locking system 24 are rotated by their handles 96 in the direction of arrow 98 (FIG. 6) to the locked position so that the locking faces 118, 120 are brought into engagement with the inside faces 124*b*, 124*a*, respectively, of the adjacent panels 20*a*, 20*b* to secure the panels 20*a*, 20*b* together as shown in FIGS. 6 and 7. During rotation of the bolt member 92, the shaft portion 110 rotates within the mounting block 50 and the intermediate portion 106 of the bolt member 92 is free to rotate in the space between the inside face 124*a* of the side member 30 and the side 84*b* of the mounting block 50. In the locked position, the handle 96 of the bolt member 92 may engage the side 84*a* of the mounting block 50 to provide additional force to hold the panels 20*a*, 20*b* tightly together. The locking systems 24 also secure the tie rods 26 within the openings 46 so that the walls of the concrete form 22 are held together in their proper spaced apart relationship to receive the concrete pour.

After use, the bolt members 92 are rotated by their handles 96 to move the locking faces 118, 120 out of engagement with the inside faces 124*b*, 124*a* of the adjacent panels 20*a*, 20*b*. The slide members 52 are then manually moved or hammered from their extended positions to their retracted positions so as to retract the projecting ends 56 from the aligned slots 48 and the tie rods 26. The locking systems 24 may remain installed on the panels 20*a*, 20*b* for future use or may be removed from the cross members 36 for installation on other panels.

Figure 8:
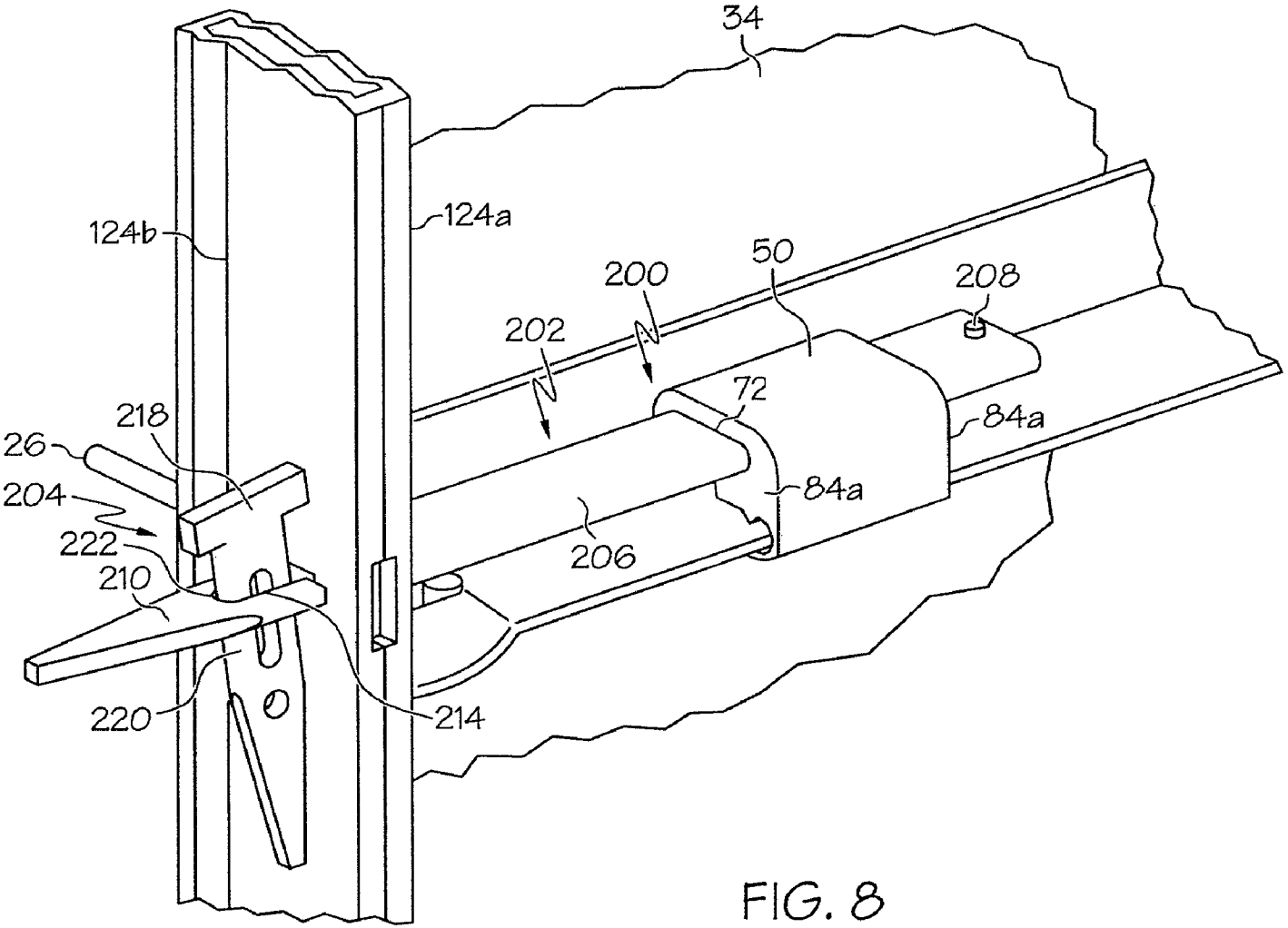
FIG. 8 is a perspective view of a locking system according to an alternative embodiment of the present invention, showing installation of the locking system on one of the adjacent concrete form panels shown in FIG. 1 and the locking system in a locked position.
Figure 9:
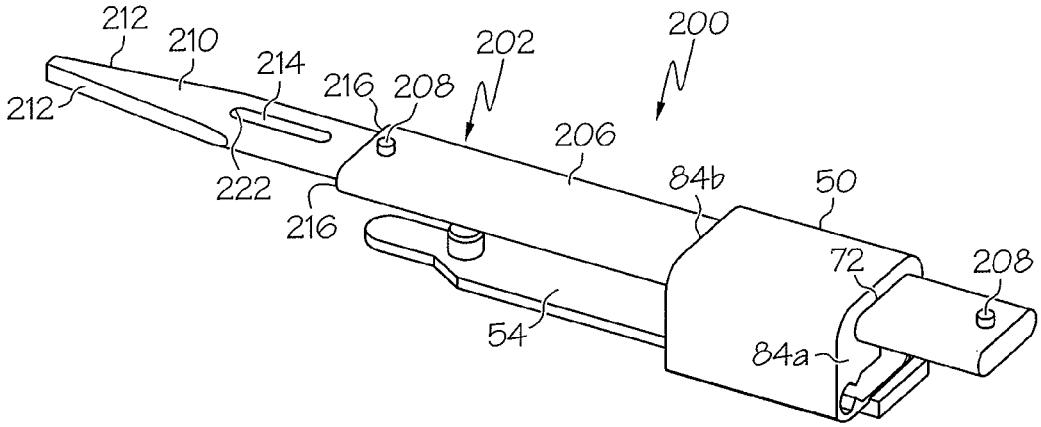
FIG. 9 is a perspective view of the locking system shown in FIG. 8.
Figure 10:
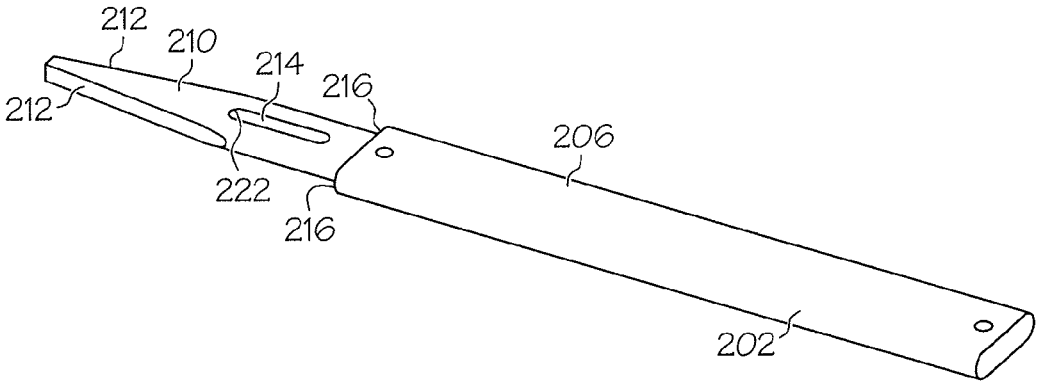
FIG. 10 is a perspective view of a bolt member used in the locking system of FIGS. 8 and 9.
Figure 11:
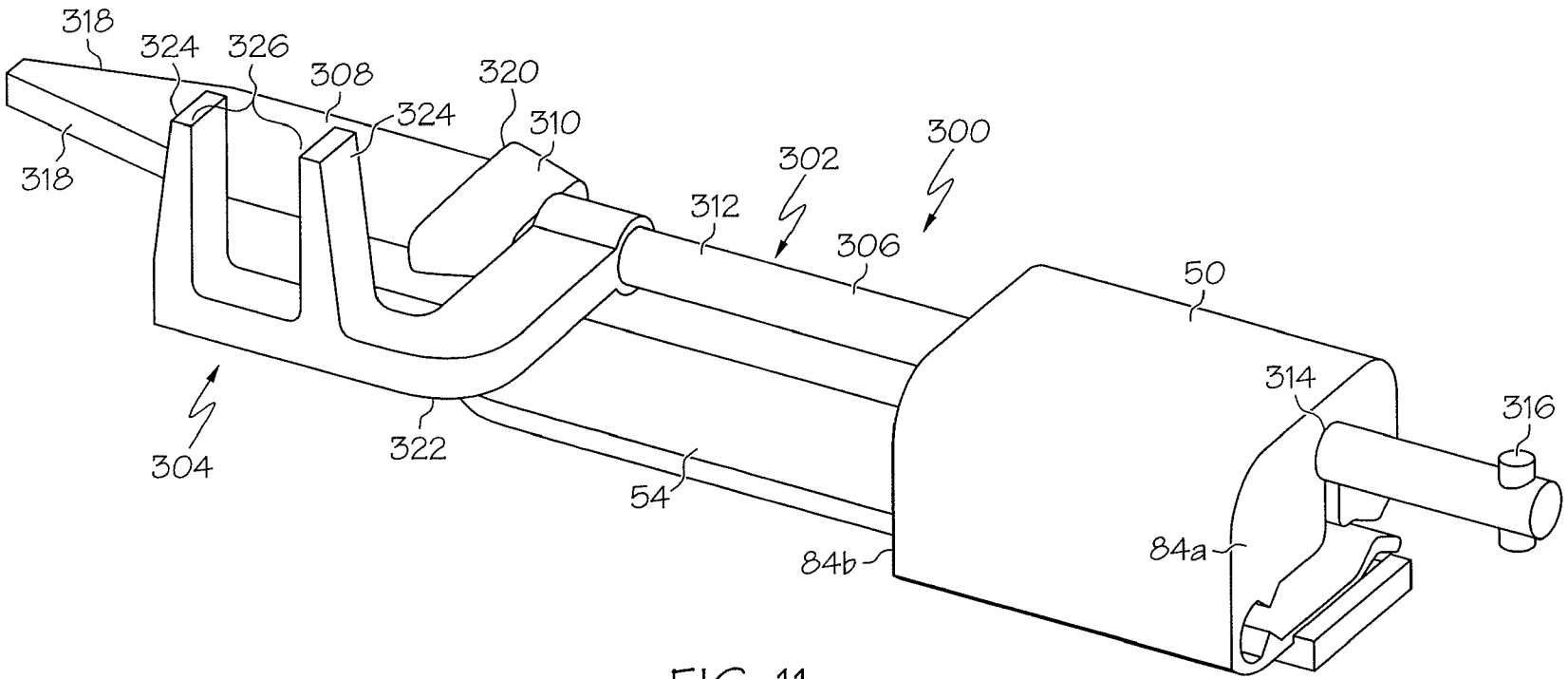
FIGS. 11 and 12 are perspective views of a locking system according to another alternative embodiment of the present invention.

Referring now to FIGS. 8-10, a locking system 200 is shown according to an alternative embodiment of the present invention, where like numerals represent like parts to the locking system 24 of FIGS. 1-7. In this embodiment, the locking system 200 includes the mounting block 50, an elongated slide member 202 supported for sliding movement relative to the mounting block 50, the mounting arm 54 connected to the mounting block 50, and a wedge member 204.

As shown in FIG. 9-10, the slide member 202 comprises an elongated bolt member 206 which is mounted for sliding movement within the horizontal opening or bore 72 of the mounting block 50 between retracted and extended positions. A pair of pins 208 (FIGS. 8 and 9) are mounted to the bolt member 206 which engage the opposite sides 84*a*, 84*b* of the mounting block 50 to prevent separation of the bolt member 206 and mounting block 50 when the bolt member 206 is moved between the retracted and extended positions.

The bolt member 206 has a projecting end 210 which extends through the aligned slots 48 when the bolt member 206 is moved to the extended position as shown in FIG. 8. The projecting end 210 has opposed side faces 212 which taper to facilitate insertion of the projecting end 210 through the aligned slots 48 and the tie rod 26. An elongated slot 214 is formed in the projecting end 210 so that at least a portion of the slot 214 is positioned within the adjacent panel 206 when the bolt member 206 is moved to its extended position. The bolt member 206 has a pair of faces 216 located on opposite sides of the projecting end 210 so that the width of the bolt member 206 at this location is wider than the width of the aligned slots 48. The sliding movement of the bolt member 206 to the extended position stops when the faces 216 of the bolt member 206 engage the inside face 124*a* of the side member 30.

The wedge member 204 of locking system 200 is configured to be inserted into the slot 214 when the bolt member 206 is moved to the extended position as shown in FIG. 8. The wedge member 204 has an enlarged head portion 218 and a projection portion 220 extending from the head portion 218. The projection portion 220 has a width less than the width of the slot 214 so that the projection portion 220 can be inserted into the slot 214 to secure the panels 20*a*, 20*b* tightly together. The head portion 218 has a width greater than the width of the slot 214 to prevent the wedge member 204 from passing through the slot 214.

In use, the locking systems 200 (one shown) are inserted onto their respective cross members 36 with the bolt members 206 of each locking system 200 moved to their retracted position. The mounting blocks 50 are installed on the cross members 36, and the panels 20*a*, 20*b* and tie rods 26 are assembled as described in detail above so as to align the bolt members 206 with the respective aligned slots 48 of the adjacent panels 20*a*, 20*b*.

Each bolt member 206 is then moved manually or hammered from its retracted position to its extended position so that the projecting end 210 of each bolt member 206 extends through its respective aligned slots 48 and the looping end of the tie rod 26. The sliding movement of the bolt member 206 to the extended position stops when the faces 216 of the bolt member 206 engage the inside face 124*a* of the side member 30.

Finally, the wedge member 204 are inserted through the slots 214 so that the projection portion 220 of each wedge member 204 engages an arcuate face 222 of the slot 214 and the head portion 218 engages the inside surface 128*b* of the panel 20*b* to secure the panels 20*a*, 20*b* tightly together as shown in FIG. 9.

After use, the wedge members 204 are removed from the slots 214. The bolt members 206 are then manually moved or hammered from their extended positions to their retracted positions so as to retract the projecting ends 210 from the aligned slots 48 and tie rods 26. The mounting block 50, mounting arm 54 and bolt member 206 may remain installed on the panels 20*a*, 20*b* for future use or may be removed from the cross members 30 for installation on other panels.

Referring now to FIGS. 11-16, a locking system 300 is shown according to another alternative embodiment of the present invention, where like numerals represent like parts to the locking system 24 of FIGS. 1-7. In this embodiment, the locking system 300 includes the mounting block 50, an elongated slide member 302 supported for sliding movement relative to the mounting block 50, the mounting arm 54 connected to the mounting block 50, and a clamp member 304 rotatably mounted on the slide member 302.

Figure 12:
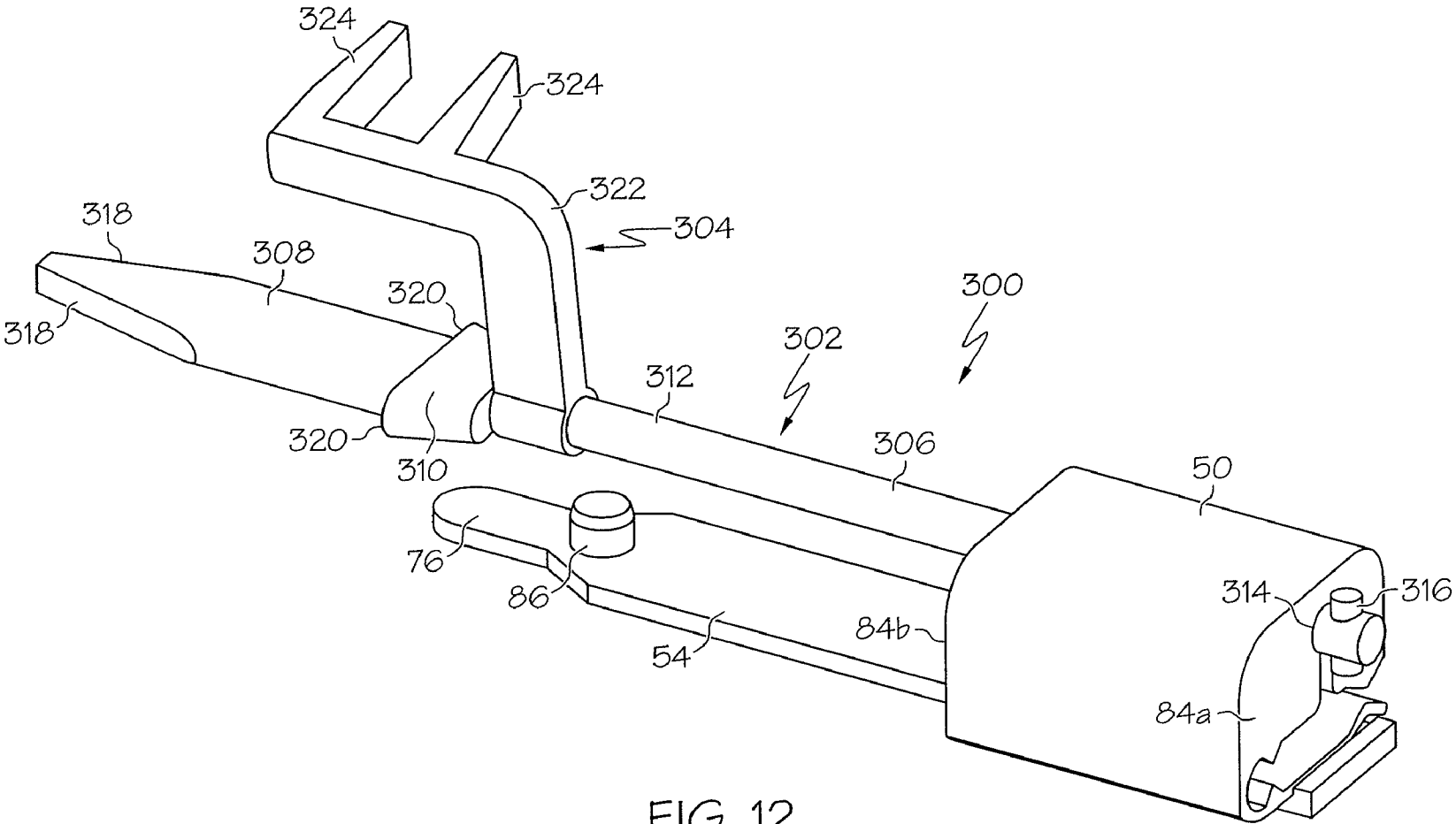
Figure 13:
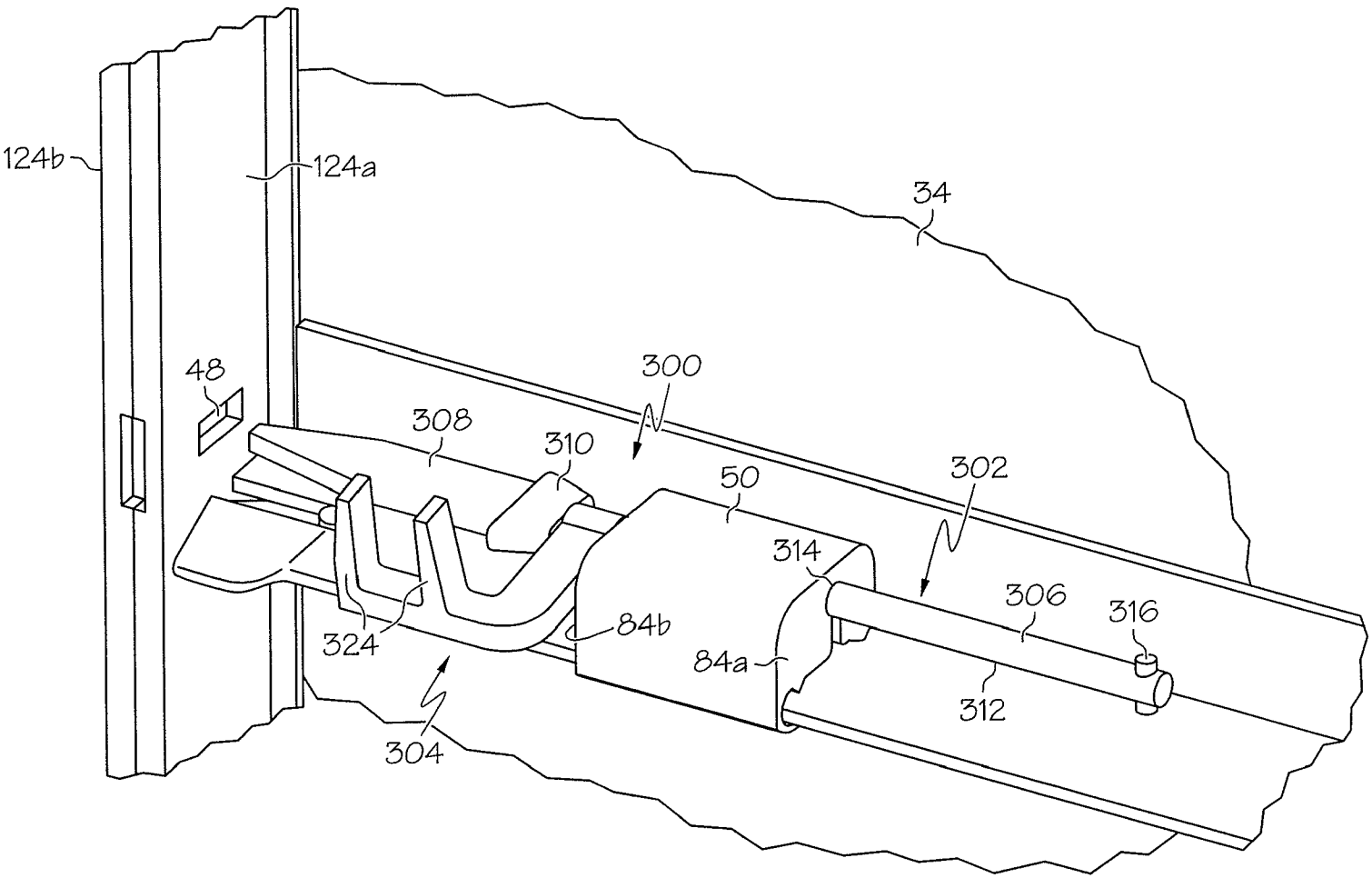
FIGS. 13 and 14 are perspective views of the locking system of FIGS. 11 and 12, showing installation of the locking system on one of the adjacent concrete form panels shown in FIG. 1 and the locking system in an unlocked position.
Figure 14:
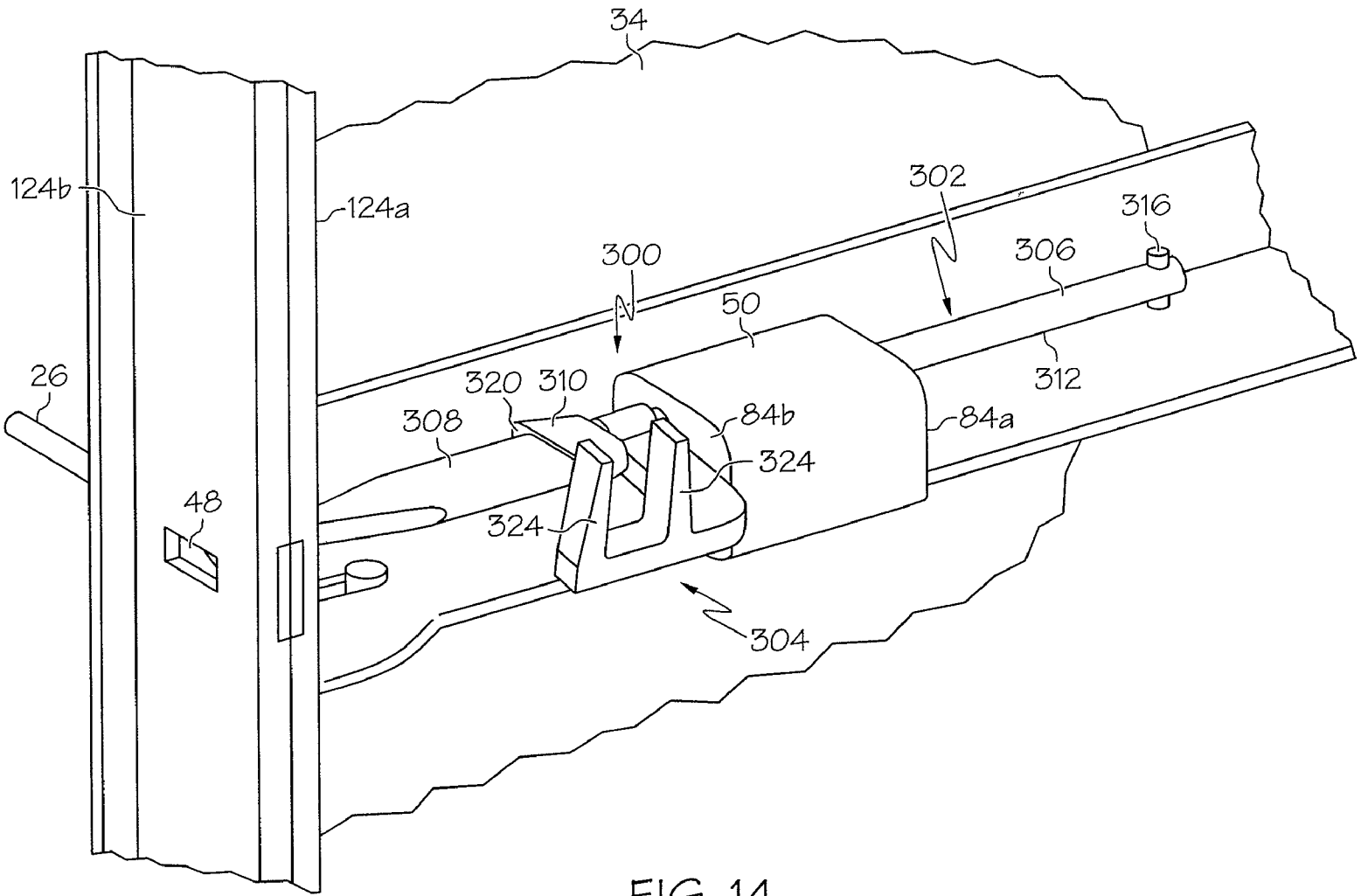
Figure 15:
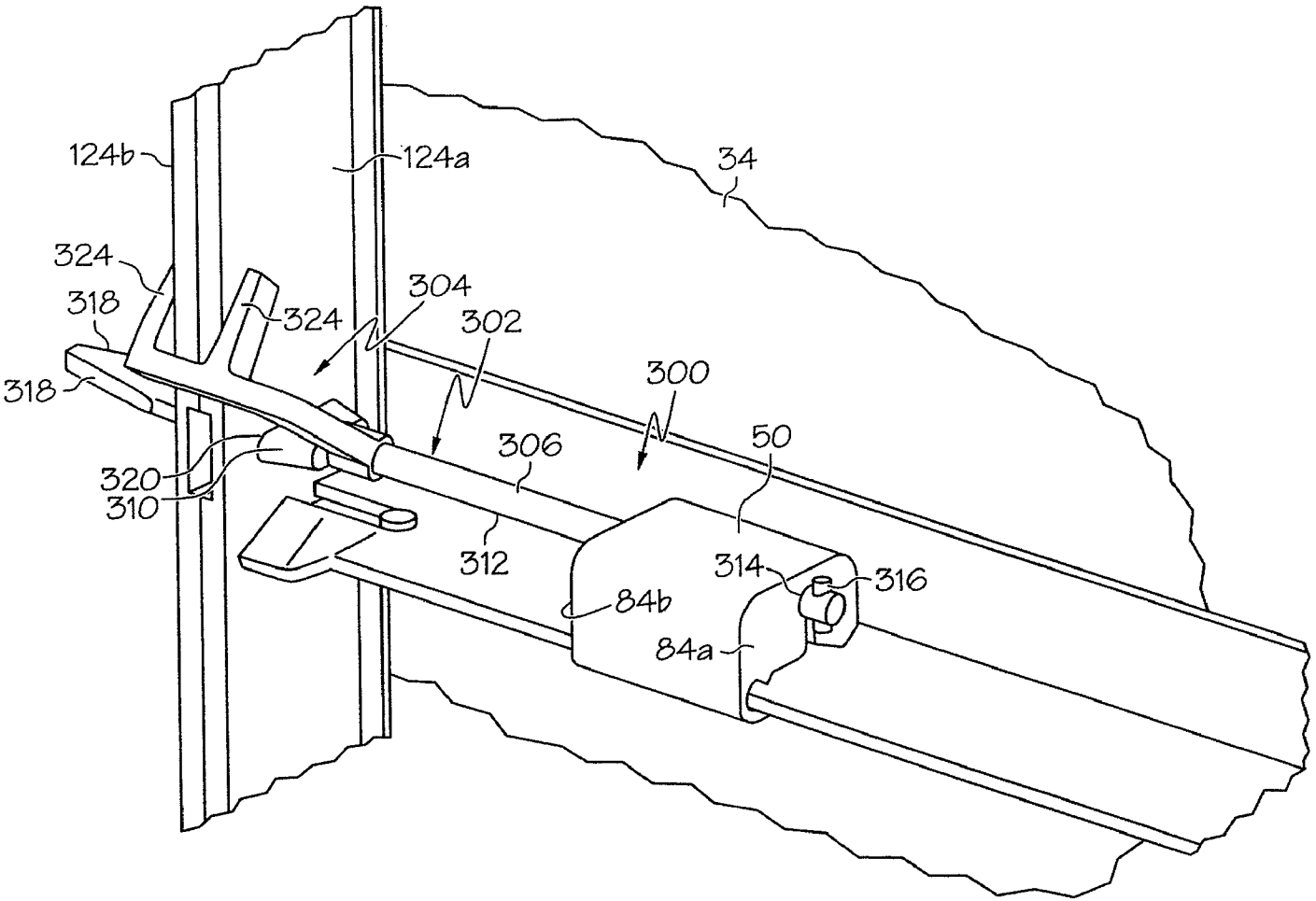
FIGS. 15 and 16 are views similar to FIGS. 13 and 14, showing the locking system in a locked position to secure the adjacent concrete form panels together.
Figure 16:
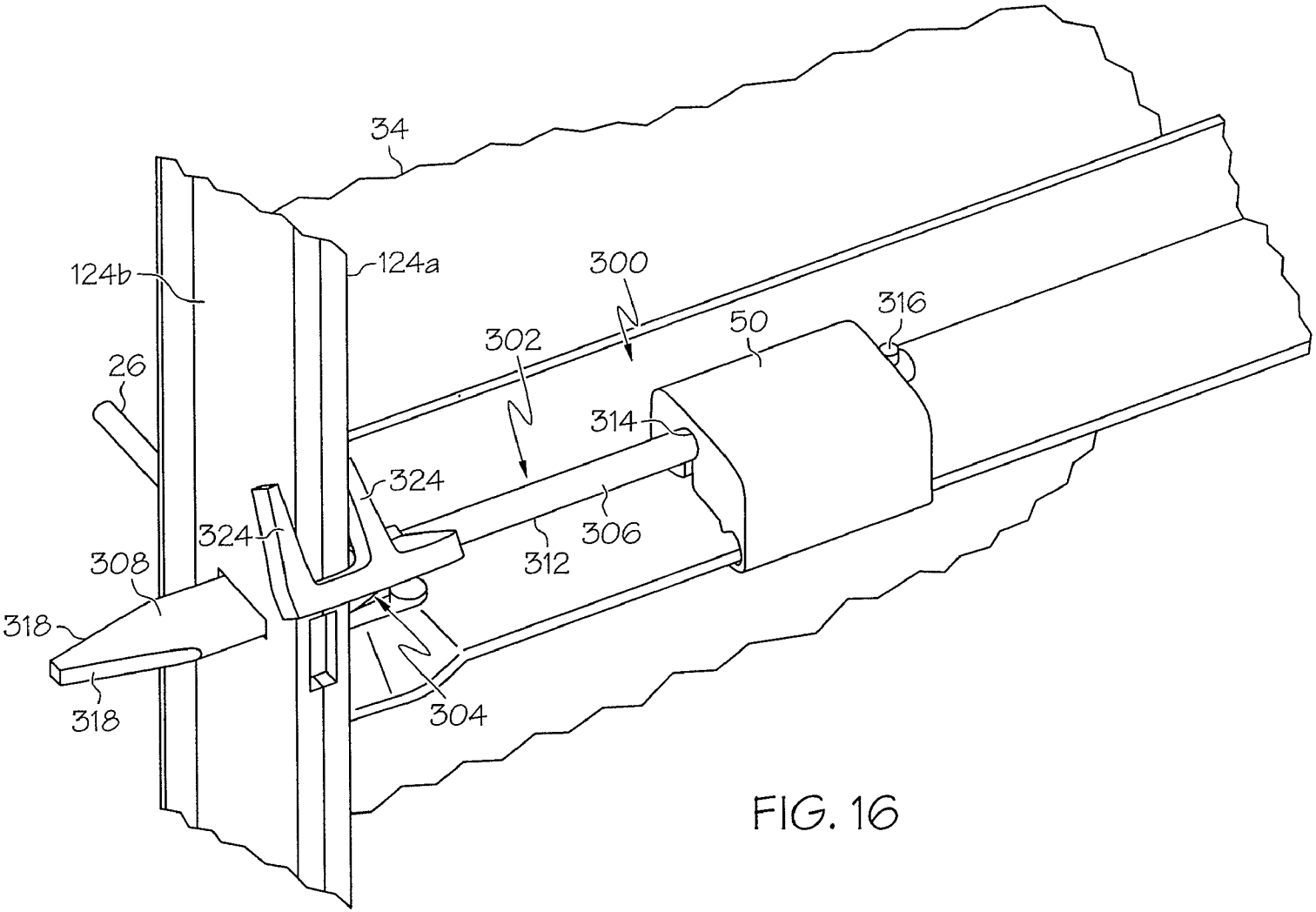

The slide member 302 comprises an elongated bolt member 306 having a projecting end 308, an intermediate head portion 310 and a generally cylindrical shaft portion 312. The shaft portion 312 is mounted within a generally cylindrical horizontal opening or bore 314 formed across the width of the mounting block 50 so that the slide member 302 is mounted for sliding movement within the opening 314 between retracted and extended positions. A pin 316 is mounted to the bolt member 306 which engages the side 84*a* of the mounting block 50 to prevent separation of the bolt member 306 and mounting block 50 when the bolt member 306 is moved to the extended position as shown in FIGS. 12, 15 and 16.

The projecting end 308 of the bolt member 306 extends through the aligned slots 48 when the bolt member 306 is moved to the extended position. The projecting end 308 has opposed side faces 318 which taper to facilitate insertion of the projecting end 308 through the aligned slots 48 and the tie rod 26. The head portion 310 has an annular face 320 extending outwardly from the projecting end 308 so that the width of the bolt member 306 at this location is wider than the width of the aligned slots 48. The sliding movement of the bolt member 306 to the extended position stops when the annular face 320 of the bolt member 306 engages the inside face 124*a* of the side member 30.

The clamp member 304 has a generally L-shaped leg 322 which is rotatably connected to the shaft portion 312 of the bolt member 306. A pair of generally parallel and spaced apart legs 324 extend outwardly from a free end of the L-shaped leg 322 and define a gap 326 (FIG. 11) therebetween. The width of the gap 326 is generally equal to the width between the inside faces 124*a*, 124*b* of the adjacent panels 20*a*, 20*b*.

In use, the locking systems 300 (one shown) are inserted onto their respective cross members 36 with the bolt members 306 of each locking system 300 moved to their retracted positions. The mounting blocks 50 are installed on the cross members 36, and the panels 20*a*, 20*b* and tie rods 26 are assembled as described in detail above so as to align the bolt members 306 with the respective aligned slots 48 of the adjacent panels 20*a*, 20*b*.

Each bolt member 306 is then moved manually or hammered from its retracted position to its extended position so that the projecting end 308 of each bolt member 306 extends through its respective aligned slots 48 and the looping end of the tie rod 26. The sliding movement of the bolt member 306 to the extended position stops when the annular face 320 of the head member 310 engages the inner face 124*a* of the side member 30. The L-shaped leg 322 positions the pair of legs 324 free of contact with the side members 30 as the bolt member 306 is moved to the extended position.

Finally, each clamp member 304 is rotated upwardly from an unlocked position to a locked position so that the pair of legs 324 engage the inner faces 124*a*, 124*b* of the adjacent panels 20*a*, 20*b* to secure the panels 20*a*, 20*b* tightly together as shown in FIGS. 15-16. Rotation of the clamp members 304 to their locked position stops when the L-shaped leg 322 engages the side members 30.

After use, the clamp members 304 are rotated to their unlocked positions to move the legs 324 out of engagement with the inside faces 124*a*, 124*b* of the adjacent panels 20*a*, 20*b*. The bolt members 306 are then manually moved or hammered from their extended positions to their retracted positions so as to retract the projecting ends 308 from the aligned slots 48 and tie rods 26. The locking systems 300 may remain installed on the panels 20*a*, 20*b* for future use or may be removed from the cross members 36 for installation on other panels.

It will be appreciated that the locking systems 24, 200 and 300 of the present invention have a minimum number of loose parts which must be carried by a worker during assembly of the concrete forms 22. This reduces the likelihood that the panel locking parts will be dropped or lost at the site. The mounting block 50 and mounting arm 54 of the present invention provide simple and accurate installation of the locking systems 24, 200 and 300 on the panels 20*a*, 20*b* so that the locking systems are reliably and accurately attached to the panels and may be readily and completely removed from the panels as may be required.

While the present invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicants' general inventive concept.

Having described the invention, we claim:

1. A locking apparatus for securing adjacent concrete form panels together, the adjacent form panels having adjacent side members including generally aligned apertures and at least one cross member extending generally perpendicularly from one of said side members, the locking apparatus comprising:

a mounting block for detachably engaging the cross member of a concrete form panel, said mounting block having a slot extending across its width, a forward slot opening, and a rearward slot stop face collectively defining a cross member insertion plane, said slot including at least one projection extending partially across said slot for engaging such a cross member; and a slide member configured to be mounted to said mounting block for sliding movement relative to said mounting block, said slide member having a projecting end for extension through the generally aligned apertures of adjacent side members, wherein said slide member is movable between a first position wherein said projecting end is positioned toward said mounting block and a second position wherein said projecting end is positioned way from said mounting block.

2. The locking apparatus of claim 1 further comprising:

a mounting arm operatively connected to said mounting block, said mounting arm having a pin oriented perpendicularly to said cross member insertion plane for pivotally engaging such a cross member so that said mounting block may be detachably engaged with such a cross member at a predetermined position.

3. The locking apparatus of claim 1 wherein said slot includes an additional projection extending partially across said slot in opposition to said prior projection to provide opposing projections for frictionally engaging such a cross member.

4. The locking apparatus of claim 1 wherein said slide member is mounted for sliding movement within said mounting block.

5. The locking apparatus of claim 4 wherein said slide member comprises:

a bolt member mounted for rotational movement within said mounting block when said slide member is moved to said second position, said bolt member being rotatable in said second position between a locked position restricting sliding movement of said slide member and an unlocked position permitting sliding movement of said slide member to said first position, and wherein said slide member projecting end comprises:

a bolt member projecting end for extension through the generally aligned apertures of adjacent side members.

6. The locking apparatus of claim 5 wherein said slide member further comprises:

a bolt support member mounted laterally adjacent to and in parallel with said bolt member for sliding movement with said bolt member within said mounting block to said first and second positions, said bolt member being rotatable with respect to said bolt support member, and said bolt support member being non-rotatable with respect to said mounting block.

7. The locking system of claim 6 wherein said said bolt member includes a first locking face for engaging a side member of a concrete form panel and a second confronting and spaced apart locking face configured to engage the other of the adjacent side members when said slide member is moved to the second position and said bolt member is rotated to the locked position.

8. The locking apparatus of claim 1 wherein said slide member comprises:

a bolt member mounted for sliding movement within said mounting block, and wherein said slide member projecting end comprises:

a bolt member projecting end having an aperture formed therethrough for extension through the generally aligned apertures of adjacent side members.

9. The locking apparatus of claim 8 wherein said projecting end aperture comprises an elongated slot.

10. The locking apparatus of claim 9 wherein said bolt member includes at least one face extending generally perpendicularly outward from said bolt member adjacent said bolt member projecting end for engaging the side member of a form panel proximate a side member aperture.

11. The locking apparatus of claim 8 further comprising:

a wedge member removeably insertable into said projecting end aperture when said slide member is in said second position for securing the adjacent side members of adjacent concrete form panels together against a portion of said slide member.

12. The locking apparatus of claim 1 wherein said slide member comprises:

a bolt member mounted for sliding movement within said mounting block, and wherein said slide member projecting end comprises:

a bolt member projecting end for extension through the generally aligned apertures of adjacent side members.

13. The locking apparatus of claim 12 further comprising:

a clamp member mounted on said bolt member for rotational movement with respect to said bolt member.

14. The locking apparatus of claim 13 wherein said bolt member includes at least one face extending generally perpendicularly outward from said bolt member adjacent said bolt member projecting end for engaging the side member of a concrete form panel proximate a side member aperture.

15. The locking apparatus of claim 1 wherein said slide member is movable between a first position wherein a slide member projecting end is retracted from the generally aligned apertures of adjacent side members and a second position wherein said slide member projecting end is extended through said generally aligned apertures.

16. A locking apparatus for securing adjacent concrete form panels together, the adjacent form panels having adjacent side members including generally aligned apertures and at least one additional projecting member, the locking apparatus comprising:

a mounting block for detachably engaging a projecting member of a concrete form panel, said mounting block having a slot for engaging such a projecting member; and a slide member configured to be mounted to said mounting block for sliding movement relative to said mounting block, said slide member having a projecting end for extension through the generally aligned apertures of adjacent side members, wherein said slide member is movable between a first position wherein said projecting end is positioned toward said mounting block and a second position wherein said projecting end is positioned away from said mounting block, and wherein said slide member comprises a bolt member configured for rotational movement only when said slide member is moved to said second position, said bolt member being rotatable in said second position between a locked position restricting sliding movement of said slide member and an unlocked position permitting sliding movement of said slide member to said first position, said slide member further comprising a bolt support member mounted laterally adjacent to and in parallel with said bolt member for sliding movement with said bolt member within said mounting block to said first and second positions, said bolt member being rotatable with respect to said bolt support member, and said bolt support member being non-rotatable with respect to said mounting block.

17. The locking system of claim 15 wherein said bolt member has a first locking face configured to engage one of the adjacent side members when said slide member is moved to the second position and a second confronting and spaced apart locking face configured to engage the other of the adjacent side members when said slide member is moved to the second position and said bolt member is rotated to the locked position.

18. A locking apparatus for securing adjacent concrete form panels together, the adjacent form panels having adjacent side members including generally aligned apertures and at least one cross member extending generally perpendicularly from one of said side members, the locking apparatus comprising:

a mounting block for detachably engaging the cross member of a concrete form panel, said mounting block having a slot extending across its width, a forward slot opening, and a rearward slot stop face collectively defining a cross member insertion plane for engaging such a cross member;

a mounting arm operatively connected to said mounting block, said mounting arm having a pin oriented perpendicularly to said cross member insertion plane, said pin being slidingly insertable into and removable from an aperture in such a cross member for pivotally engaging that cross member so that said mounting block may be detachably engaged with that same cross member at a predetermined position; and a slide member configured to be mounted to said mounting block for sliding movement relative to said mounting block, said slide member having a projecting end for extension through the generally aligned apertures of adjacent side members, wherein said slide member is movable between a first position wherein said projecting end is positioned toward said mounting block and a second position wherein said projecting end is positioned away from said mounting block, and wherein said slide member comprises a bolt member mounted for rotational movement within said mounting block when said slide member is moved to said second position, said bolt member being rotatable in said second position between a locked position restricting sliding movement of said slide member and an unlocked position permitting sliding movement of said slide member to said first position.

19. The locking apparatus of claim 18 wherein said slide member further comprises:

a bolt support member mounted laterally adjacent to and in parallel with said bolt member for sliding movement with said bolt member relative to said mounting block to said first and second positions, said bolt member being rotatable with respect to said bolt support member, and said bolt support member being non-rotatable with respect to said mounting block.

20. The locking apparatus of claim 19 wherein said bolt member has a first locking face configured to engage one of the adjacent side members when said slide member is moved to the second position and a second confronting and spaced apart locking face configured to engage the other of the adjacent side members when said slide member is moved to the second position and said bolt member is rotated to the locked position.

21. A locking apparatus for securing adjacent concrete form panels together, the adjacent form panels having adjacent side members including generally aligned apertures and at least one cross member extending generally perpendicularly from one of said side members, the locking apparatus comprising:

a mounting block for detachably engaging the cross member of a concrete form panel, said mounting block having a slot extending across its width, a forward slot opening, and a rearward slot stop face collectively defining a cross member insertion plane for engaging such a cross member;

a mounting arm operatively connected to said mounting block, said mounting arm having a pin oriented perpendicularly to said cross member insertion plane, said pin being slidingly insertable into and removable from an aperture in such a cross member for pivotally engaging that cross member so that said mounting block may be detachably engaged with that same cross member at a predetermined position; and said slot includes opposing projections extending partially across said slot for frictionally engaging such a cross member.

22. A locking system for securing adjacent concrete form panels together, the locking system comprising:

at least one pair of adjacent form panels, each of said form panels having a pair of opposed end members and a pair of opposed side members defining a panel frame and at least one cross member disposed generally parallel to said end members and perpendicular to said side members, adjacent side members of said adjacent panels having apertures formed therein which are generally aligned;

a mounting block detachably engaging a cross member of one of said form panels, said mounting block having a slot formed therein including at least one projection extending partially across said slot to detachably engage said cross member; and a slide member configured to be mounted to said mounting block for sliding movement relative to said mounting block between a first position wherein a slide member projecting end is retracted from said aligned apertures and a second position wherein said slide member projecting end is extended through said aligned apertures.

23. The locking system of claim 22 further comprising:

a mounting arm operatively connected to said mounting block and being configured to pivotally engage with said cross member so that said mounting block may detachably engage with said cross member at a predetermined position.

24. The locking system of claim 22 wherein said slot includes an additional projection extending partially across said slot in opposition to said prior projection to provide opposing projections for frictionally engaging said cross member.

25. The locking system of claim 22 wherein said slide member is mounted for sliding movement within said mounting block.

26. The locking system of claim 25 wherein said slide member comprises:

a bolt member mounted for rotational movement within said mounting block when said slide member is moved to said second position, said bolt member being rotatable in said second position between a locked position to secure said adjacent side members together and an unlocked position to permit movement of said slide member to said first position.

27. The locking system of claim 26 wherein said slide member further comprises:

a bolt support member mounted for sliding movement with said bolt member relative to said mounting block to said first and second positions.

28. The locking system of claim 27 wherein said bolt member has a first locking face configured to engage one of said adjacent side members when said slide member is moved to said second position and a second confronting and spaced apart locking face configured to engage the other of said adjacent side members when said slide member is moved to said second position and said bolt member is rotated to said locked position.

29. The locking system of claim 22 wherein said slide member comprises:

a bolt member mounted for sliding movement within said mounting block, and wherein said slide member projecting end comprises:

a bolt member projecting end having an aperture formed therethrough.

30. The locking system of claim 29 wherein said projecting end aperture comprises an elongated slot.

31. The locking system of claim 30 wherein said bolt member has at least one face configured to engage one of said adjacent side members proximate said aligned apertures when said slide member is moved to said second position.

32. The locking system of claim 31 further comprising:

a wedge member configured to engage said aperture and the other of said adjacent side members when said slide member is moved to said second position and said wedge member is mounted within said aperture.

33. The locking system of claim 22 wherein said slide member comprises a bolt member mounted for sliding movement within said mounting block.

34. The locking system of claim 33 further comprising:

a clamp member mounted on said bolt member for rotational movement with respect to said bolt member, said clamp member being rotatable between a locked position to secure said adjacent side members together when said slide member is moved to said second position and an unlocked position to permit movement of said slide member to said first position.

35. The locking system of claim 34 wherein said bolt member has at least one face configured to engage one of said adjacent side members proximate said aligned apertures when said slide member is moved to said second position.

36. A locking system for securing adjacent concrete form panels together, comprising:

at least one pair of adjacent form panels, each of said form panels having a pair of opposed end members and a pair of opposed side members defining a panel frame, adjacent side members of said adjacent panels having apertures formed therein which are generally aligned;

a mounting block configured to be supported on one of the adjacent panels; and a slide member configured to be mounted to said mounting block for sliding movement relative to said mounting block between a first position wherein a slide member projecting end is retracted from said aligned apertures and a second position wherein said slide member projecting end is extended through said aligned apertures, and wherein said slide member comprises a bolt member mounted for rotational movement within said mounting block only when said slide member is moved to the second position, said bolt member being rotatable in the second position between a locked position to secure said adjacent panels together and an unlocked position to permit movement of said slide member to said first position.

37. The locking system of claim 36 wherein said slide member further comprises:

a bolt support member mounted for sliding movement with said bolt member relative to said mounting block to said first and second positions.

38. The locking system of claim 37 wherein said bolt support member has a first locking face configured to engage one of said adjacent side members when said slide member is moved to said second position and a second confronting and spaced apart locking face configured to engage the other of said adjacent side members when said slide member is moved to said second position and said bolt member is rotated to said locked position.

39. A locking system for securing adjacent concrete form panels together, comprising:

at least one pair of adjacent form panels, each of said form panels having a pair of opposed end members and a pair of opposed side members defining a panel frame and at least one cross member disposed generally parallel to the end members and perpendicular to said side members, adjacent side members of said adjacent panels having apertures formed therein which are generally aligned;

a mounting block having a slot formed therein configured to detachably engage with a cross member of one of said adjacent panels; and a mounting arm operatively connected to said mounting block and being configured to pivotally engage with said cross member so that said mounting block may detachably engage with said cross member at a predetermined position.

40. The locking system of claim 39 further comprising:

a slide member configured to be mounted to said mounting block for sliding movement relative to said mounting block between a first position wherein a slide member projecting end is retracted from said aligned apertures and a second position wherein said slide member projecting end is extended through said aligned apertures, and wherein said slide member comprises a bolt member mounted for rotational movement within said mounting block when said slide member is moved to said second position, said bolt member being rotatable in said second position between a locked position to secure the adjacent side members together and an unlocked position to permit movement of said slide member to said first position.

41. The locking system of claim 40 wherein said slide member further comprises:

a bolt support member mounted for sliding movement with said bolt member relative to said mounting block to said first and second positions.

42. The locking system of claim 41 wherein said bolt support member has a first locking face configured to engage one of said adjacent side members when said slide member is moved to said second position and a second confronting and spaced apart locking face configured to engage the other of said adjacent side members when said slide member is moved to said second position and said bolt member is rotated to said locked position.

43. The locking system of claim 42 wherein said slot is configured to frictionally engage said cross member.

44. A method of securing adjacent concrete form panels together, the adjacent form panels having adjacent side members including generally aligned apertures and at least one cross member extending generally perpendicularly from one of said side members, the method comprising the steps of:

engaging a mounting arm with the cross member of a form panel;

pivoting a mounting block operatively connected to said mounting arm into contact with said cross member at a predetermined position;

driving a slot formed in said mounting block into detachable engagement with said cross member at said predetermined position; and moving a slide member mounted to said mounting block toward said adjacent side members to extend a slide member projecting end through said aligned apertures.

45. The method of claim 44 further comprising the step of:

operating a portion of said slide member to secure said adjacent side members together.

46. The method of claim 44 further comprising the step of:

inserting a wedge through an aperture in said slide member projecting end to secure said adjacent side members against said slide member.

* * * * *

UNITED STATES PATENT AND TRADEMARK OFFICE

CERTIFICATE OF CORRECTION

PATENT NO. : 8,042,786 B2
APPLICATION NO. : 11/570071
DATED : October 25, 2011
INVENTOR(S) : Robert Spindler It is certified that error appears in the above-identified patent and that said Letters Patent is hereby corrected as shown below:

Claim 1, Column 11, Line 58, “way” should read -- away --.

Signed and Sealed this
Third Day of January, 2012

David J. Kappos

David J. Kappos
*Director of the United States Patent and Trademark Office*